US011691445B2

(12) United States Patent
Okui et al.

(10) Patent No.: US 11,691,445 B2
(45) Date of Patent: Jul. 4, 2023

(54) LIQUID EJECTING APPARATUS AND METHOD OF FIXING LIQUID EJECTING HEAD

(71) Applicant: Seiko Epson Corporation, Tokyo (JP)

(72) Inventors: Hiroaki Okui, Azumino (JP); Eiichiro Watanabe, Matsumoto (JP)

(73) Assignee: SEIKO EPSON CORPORATION

( * ) Notice: Subject to any disclaimer, the term of this patent is extended or adjusted under 35 U.S.C. 154(b) by 0 days.

(21) Appl. No.: 17/573,668

(22) Filed: Jan. 12, 2022

(65) Prior Publication Data

US 2022/0219469 A1 Jul. 14, 2022

(30) Foreign Application Priority Data

Jan. 13, 2021 (JP) ..... 2021-003211

(51) Int. Cl.
*B41J 25/34* (2006.01)
*B41J 2/01* (2006.01)
*B41J 2/145* (2006.01)

(52) U.S. Cl.
CPC ..... *B41J 25/34* (2013.01); *B41J 2/01* (2013.01); *B41J 2/145* (2013.01); *B41J 2202/20* (2013.01); *B41J 2202/21* (2013.01)

(58) Field of Classification Search
CPC ..... B41J 25/34; B41J 2/01; B41J 2/145; B41J 2202/20; B41J 2202/21
See application file for complete search history.

(56) References Cited

U.S. PATENT DOCUMENTS

2005/0062799 A1* 3/2005 Kitahara ..... B41J 2/16532 347/40
2009/0079792 A1* 3/2009 Koizumi ..... B41J 2/145 347/47
2014/0253636 A1* 9/2014 Silverbrook ..... B41J 2/21 347/42
2018/0257378 A1 9/2018 Kinoshita
2020/0147957 A1 5/2020 Saito et al.

FOREIGN PATENT DOCUMENTS

JP 2018-149684 A 9/2018
JP 2020-075454 A 5/2020

* cited by examiner

*Primary Examiner* — Henok D Legesse
(74) *Attorney, Agent, or Firm* — Harness, Dickey & Pierce, P.L.C.

(57) ABSTRACT

A liquid ejecting apparatus includes a liquid ejecting head, a holding member holding the liquid ejecting head, a fixing member including a head portion, an engaging portion, and a shaft portion that couples the head portion to the engaging portion, and an elastic member including a first opening into which the shaft portion is inserted. One of the liquid ejecting head and the holding member includes a second opening into which the shaft portion is inserted, and the other one of the liquid ejecting head and the holding member includes a first engaged portion to be engaged with the engaging portion. The liquid ejecting head is fixed to the holding member by the engaging portion being brought into engagement with the first engaged portion such that the first opening and the second opening are disposed between the head portion and the engaging portion.

19 Claims, 23 Drawing Sheets

LIQUID EJECTING APPARATUS AND METHOD OF FIXING LIQUID EJECTING HEAD

The present application is based on, and claims priority from JP Application Serial Number 2021-003211, filed Jan. 13, 2021, the disclosure of which is hereby incorporated by reference herein in its entirety.

BACKGROUND

1. Technical Field

The present disclosure relates to a liquid ejecting apparatus and a method of fixing a liquid ejecting head.

2. Related Art

There has been known a liquid ejecting apparatus as represented by an ink jet printer, which ejects a liquid such as an ink.

A liquid ejecting apparatus described in JP-A-2018-149684 includes head bodies that eject inks and a unit base that holds the head bodies. Each head body is fixed to the unit base through a spacer by using screw members.

However, the method of fixing the head body to the unit base by using the screw members has a problem that it is not easy to attach and replace the head body. To deal with this, there has been a demand for a liquid ejecting apparatus that enables easy fixation of a head body to a unit base.

SUMMARY

A liquid ejecting apparatus according to an aspect of the present disclosure includes a liquid ejecting head that ejects a liquid, a holding member that holds the liquid ejecting head, a fixing member including a head portion, an engaging portion, and a shaft portion that couples the head portion to the engaging portion, and an elastic member including a first opening into which the shaft portion is inserted. One of the liquid ejecting head and the holding member includes a second opening into which the shaft portion is inserted, and the other one of the liquid ejecting head and the holding member includes a first engaged portion to be engaged with the engaging portion. The liquid ejecting head is fixed to the holding member by the engaging portion being brought into engagement with the first engaged portion such that the first opening and the second opening are disposed between the head portion and the engaging portion.

A method of fixing a liquid ejecting head according to an aspect of the present disclosure provides a method of fixing a liquid ejecting head including, fixing a liquid ejecting head to a holding member by using a fixing member including a head portion, an engaging portion, and a shaft portion that couples the head portion to the engaging portion, and an elastic member including a first opening into which the shaft portion is inserted, the elastic member being brought into contact with the head portion. One of the liquid ejecting head and the holding member includes a second opening into which the shaft portion is inserted, and another one of the liquid ejecting head and the holding member includes a first engaged portion to be engaged with the engaging portion. The liquid ejecting head is fixed to the holding member by the engaging portion being brought into engagement with the first engaged portion such that the first opening and the second opening are disposed between the head portion and the engaging portion while the elastic member is pressed with the head portion.

DESCRIPTION OF EXEMPLARY EMBODIMENTS

Figure 1:
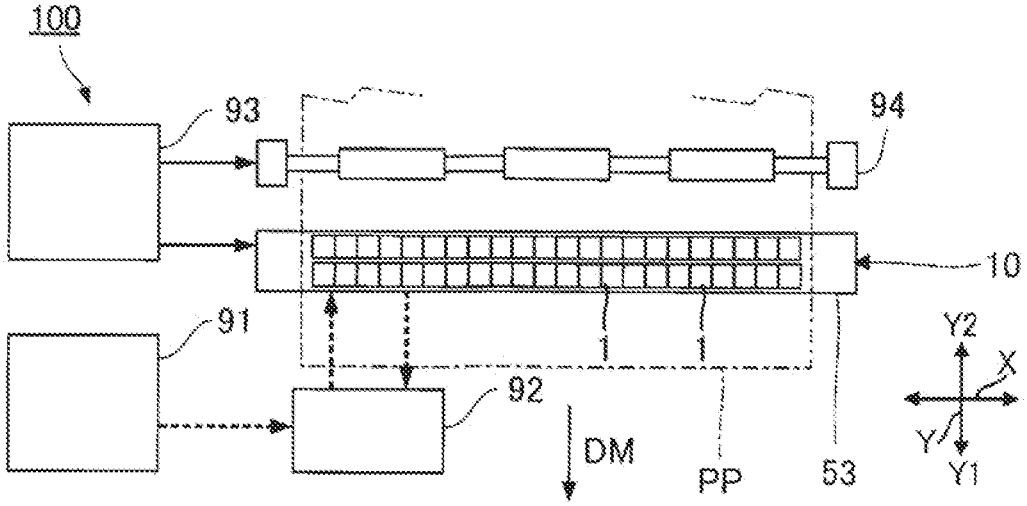
FIG. 1 is a schematic diagram illustrating a configuration example of a liquid ejecting apparatus according to a first embodiment.

Modes for carrying out the present disclosure will be described below with reference to the drawings. It is to be noted, however, that dimensions and scales of constituents in the drawings may be different from reality as appropriate. Moreover, the following embodiments represent preferred specific examples of the present disclosure and are therefore provided with various restrictions which are deemed to be favorable from technical perspectives. However, the scope of the present disclosure is not limited to these embodiments unless there is a specific statement to restrict the scope of the present disclosure in the following description.

The following description will be given by appropriately using the x axis, the y axis, and the z axis which are orthogonal to one another. Meanwhile, one direction along the x axis will be referred to as x1 direction while a direction opposite to the x1 direction will be referred to as x2 direction. Likewise, one direction along the y axis will be referred to as y1 direction while a direction opposite to the y1 direction will be referred to as y2 direction. Moreover, one direction along the z axis will be referred to as z1 direction while a direction opposite to the z1 direction will be referred to as z2 direction. In the meantime, view in the z1 direction or the z2 direction will be referred to as "plan view". Meanwhile, view of a section taken along a plane including the z axis in a direction orthogonal to the z axis will be referred to as "cross-sectional view". In the meantime, the direction along the z axis corresponds to a gravitational direction. The z1 direction corresponds to "downward in the gravitational direction" while the z2 direction corresponds to "upward in the gravitational direction".

1. First Embodiment

1-1. Overall Configuration of Liquid Ejecting Apparatus 100

FIG. 1 is a schematic diagram illustrating a configuration example of a liquid ejecting apparatus 100 according to a first embodiment. The liquid ejecting apparatus 100 illustrated in FIG. 1 is a printing apparatus of an ink jet type which ejects an ink as an example of a "liquid" onto a medium PP in the form of droplets. The liquid ejecting apparatus 100 of this embodiment is a printing apparatus of so-called a line type which distributes multiple nozzles for ejecting the ink across an entire range in a width direction of the medium PP. Though the medium PP is typically print paper, a print target of an arbitrary material such as a resin film and a cloth is also used as the medium PP.

The liquid ejecting apparatus 100 illustrated in FIG. 1 includes a circulation mechanism 92, a control unit 93, a medium transportation mechanism 94, and a head unit 10. The head unit 10 includes liquid ejecting heads 1. Moreover, a liquid container 91 is installed in the liquid ejecting apparatus 100.

The liquid container 91 is a liquid storage unit that stores the ink. For example, a cartridge that is attachable to and detachable from the liquid ejecting apparatus 100, an ink package having a bag shape formed from a flexible film, or an ink-refillable ink tank is used for the liquid container 91. Any type of the ink may be stored in the liquid container 91. For example, the liquid container 91 includes multiple sub-containers for storing inks of types different from one another.

The circulation mechanism 92 supplies the ink stored in the liquid container 91 to the liquid ejecting head 1. To be more precise, the circulation mechanism 92 supplies the ink stored in the liquid container 91 to the liquid ejecting head 1, and collects the ink discharged from the liquid ejecting head 1 and returns the ink to the liquid ejecting head 1 again. For example, the circulation mechanism 92 includes a flow channel for supplying the ink to the liquid ejecting head 1, a flow channel for collecting the ink discharged from the liquid ejecting head 1, a sub-tank for storing the collected ink, a pump for transferring the ink, and the like.

The control unit 93 is a control device that controls operations of respective elements included in the liquid ejecting apparatus 100. The control unit 93 includes a processing circuit such as a central processing unit (CPU) and a field programmable gate array (FPGA), and a storage circuit such as a semiconductor memory. Various programs and various data are stored in the storage circuit. The processing circuit achieves a variety of control by executing the programs and using the data as appropriate.

The medium transportation mechanism 94 transports the medium PP in a direction of transportation DM by being controlled by the control unit 93. Here, the direction of transportation DM is the y1 direction, for example. The direction of transportation DM is not limited only to the y1 direction, but may also be other directions. The medium transportation mechanism 94 includes a transportation roller that is elongate along the x axis, and a motor that rotates the transportation roller. Note that the medium transportation mechanism 94 is not limited only to the configuration to use the transportation roller. For example, the medium transportation mechanism 94 may be configured to use a drum that transports the medium PP in a state of being stuck to an outer peripheral surface by use of static electricity or the like, or configured to use an endless belt.

The head unit 10 is a line head in which the liquid ejecting heads 1 are arranged along the x axis. The liquid ejecting heads 1 eject the ink from the respective nozzles to the medium PP under the control of the control unit 93. An image is formed on a surface of the medium PP by ejecting the ink onto the medium PP from the respective liquid ejecting heads 1 in parallel with the transportation of the medium PP by the medium transportation mechanism 94.

1-2. Head Unit 10

Figure 2:
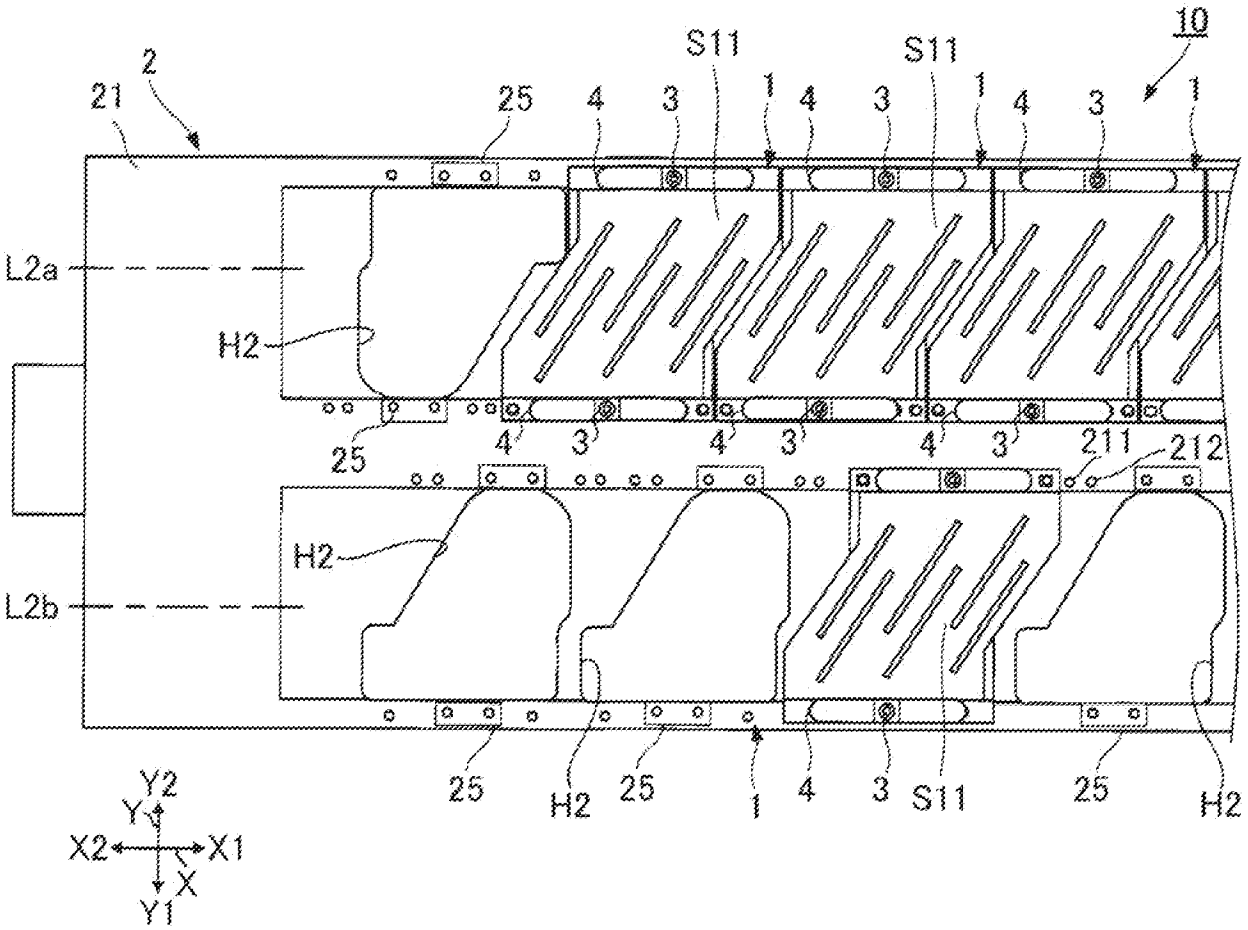
FIG. 2 is a plan view of a head unit in FIG. 1.
Figure 3:
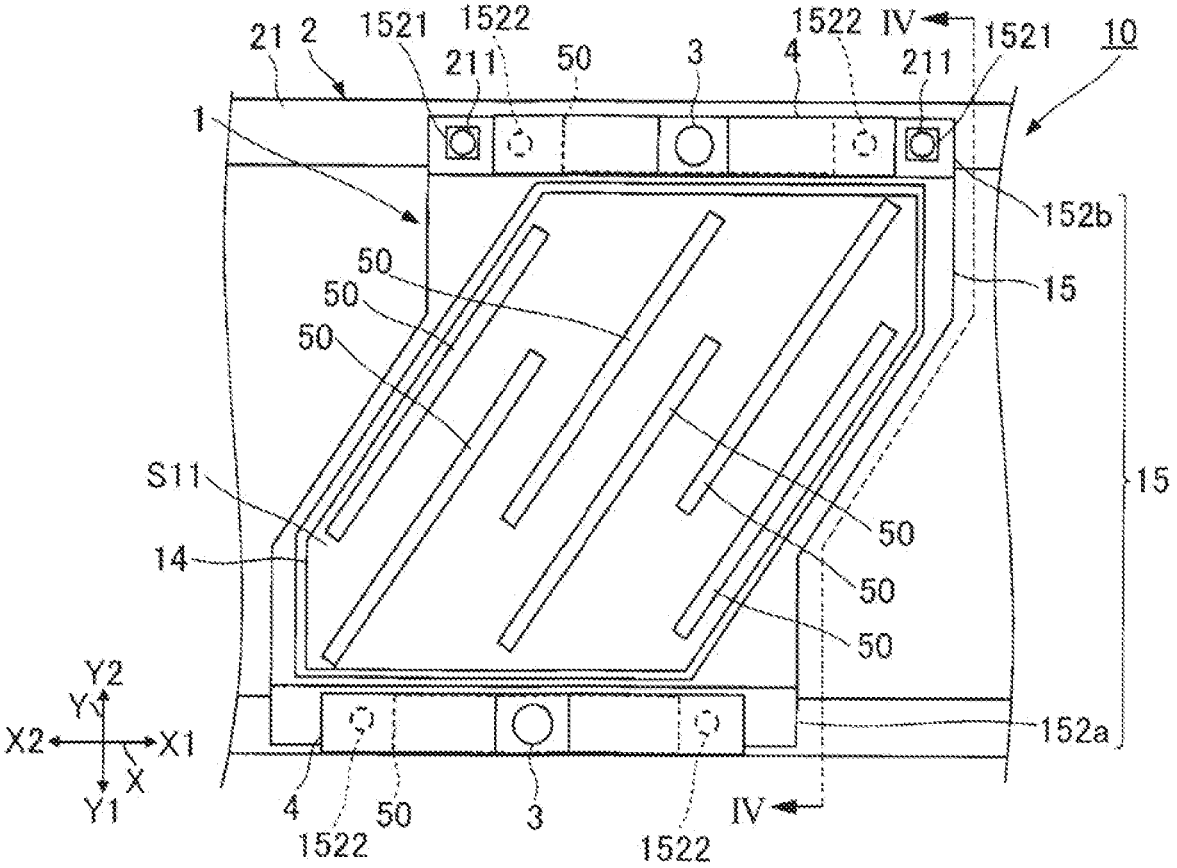
FIG. 3 is a partially enlarged view of the head unit in FIG. 2.

FIG. 2 is a plan view of the head unit 10 in FIG. 1. FIG. 3 is a partially enlarged view of the head unit 10 in FIG. 2.

Figure 4:
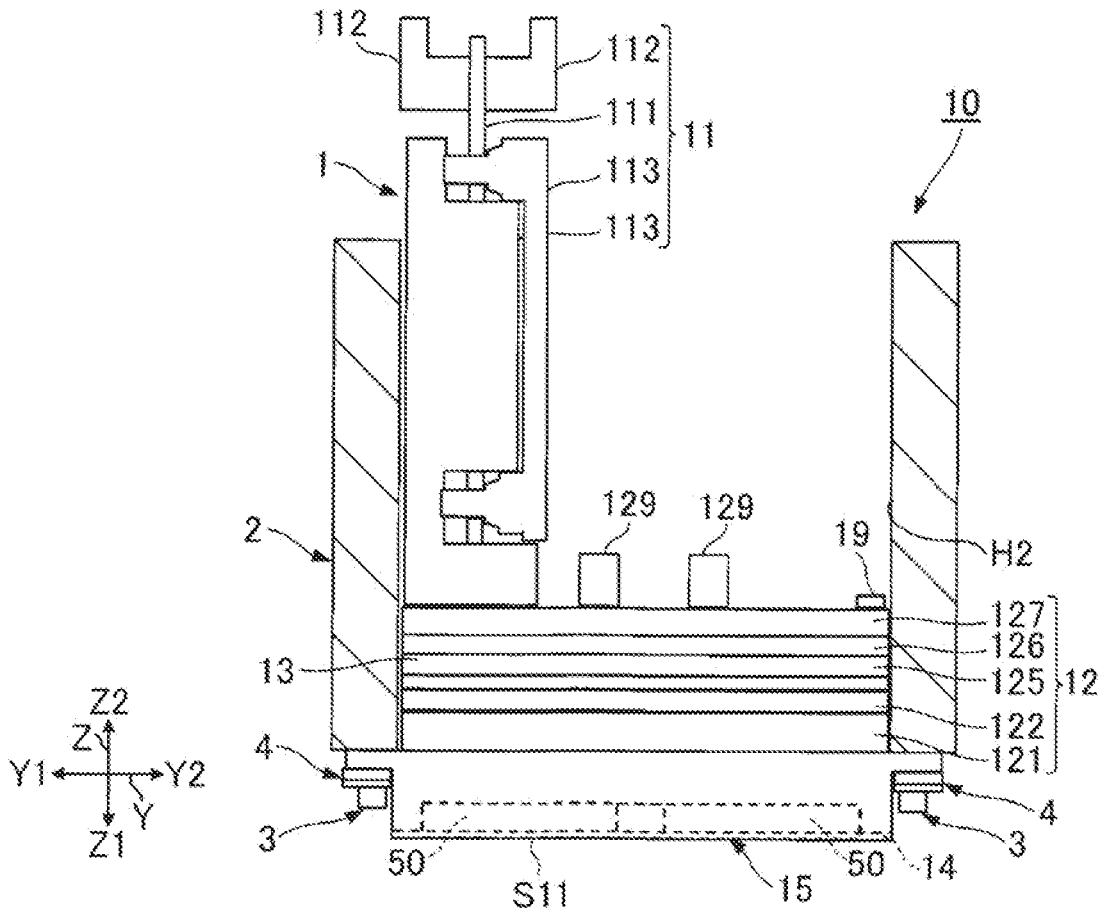
FIG. 4 is a view corresponding to a cross-section taken along the IV-IV line in FIG. 3.
Figure 5:
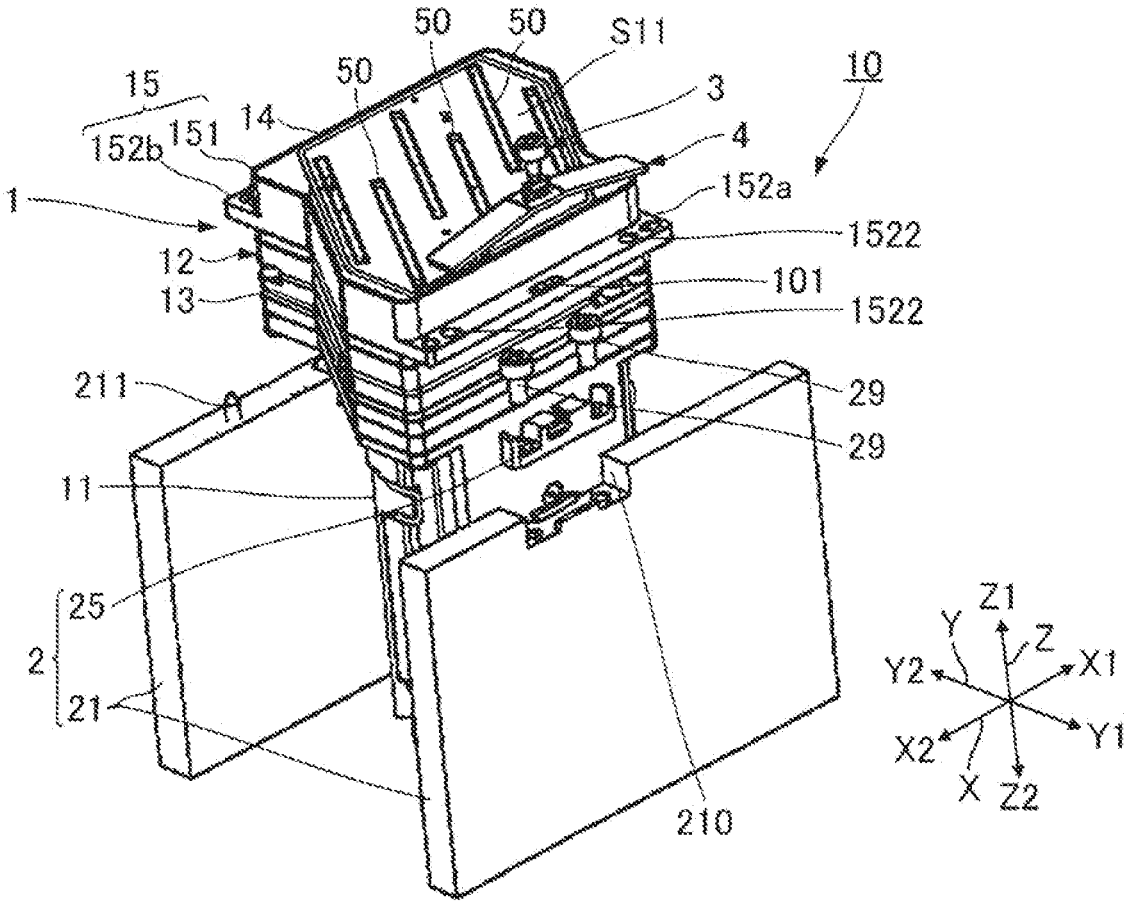
FIG. 5 is an exploded perspective view of FIG. 4.

FIG. 4 corresponds to a cross-section taken along the IV-IV line in FIG. 3. FIG. 5 is an exploded perspective view of FIG. 4.

In addition to the liquid ejecting heads 1, the head unit 10 includes a holding member 2, fixing members 3, and elastic members 4 as illustrated in FIGS. 2 to 5.

1-2a. Holding Member 2

The holding member 2 illustrated in FIG. 2 is a carriage that holds the liquid ejecting heads 1. A body portion 21 is an elongate member that extends in the x1 direction. The material of the body portion 21 is a metal such as aluminum and stainless steel, or a resin. When the head unit 10 is formed into the line head that is elongate in the x1 direction as discussed in this embodiment, a highly rigid metal material may be used for the body portion 21 so as to avoid deformation even when holding two or more liquid ejecting heads 1.

The holding member 2 includes the body portion 21 and engaged members 25. The body portion 21 includes openings H2. Each opening H2 is a wall portion that forms a hole to penetrate the holding member 2. The openings H2 are provided one by one to the liquid ejecting heads 1. The liquid ejecting heads 1 are held by the holding member 2 in the state of being inserted into the respective openings H2. In FIG. 2, illustration of part of the liquid ejecting heads 1 is omitted in order to facilitate the understanding of the openings H2.

In the example illustrated in FIG. 2, the openings H2 are divided into a first row L2*a* and a second row L2*b*, and the openings H2 in each row are arranged in the x1 direction. Here, the shape of the holding member 2 is such a shape that is symmetric with respect to the center of the holding member 2 in plan view. Meanwhile, although illustration is omitted, when a surface of a transportation drum for transporting the medium PP has a curved shape, a surface of the holding member 2 opposed to the surface of the transportation drum is slightly inclined so as to trace this surface relative to a plane that has a virtual line extending along the gravitational direction as a normal line, or in other words, a horizontal plane. Likewise, an ejecting surface S11 of each liquid ejecting head 1 to be described later is slightly inclined relative to the plane that has the virtual line extending along the gravitational direction as the normal line, or in other words, the horizontal plane.

As illustrated in FIGS. 3 and 5, the body portion 21 is provided with positioning pins 211. Two positioning pins 211 are provided to each liquid ejecting head 1. As illustrated in FIG. 5, the positioning pins 211 project in the z2 direction from the body portion 21. The positioning pins 211 are used for positioning the liquid ejecting heads 1 relative to the holding member 2. As illustrated in FIG. 2, the positioning pins 211 are provided corresponding to the after-mentioned positioning holes 1521 included in the liquid ejecting head 1. Here, such positioning holes may be provided to the body portion 21 of the holding member 2 and the corresponding positioning pins may be provided to the liquid ejecting heads 1 instead.

As illustrated in FIG. 5, the body portion 21 includes a recess 210. The engaged member 25 is disposed in the recess 210. The engaged member 25 is used for fixing the liquid ejecting head 1 to the holding member 2. The engaged member 25 will be described later in detail.

1-2b. Elastic Members 4

As illustrated in FIG. 2, two elastic members 4 are provided to each of the liquid ejecting heads 1. Each elastic member 4 is an elastic plate spring, for example. The elastic members 4 are used for fixing the liquid ejecting heads 1 to the holding member 2. Although the material of the elastic members 4 is not limited to a particular material, the elastic members 4 are made of a metal such as stainless steel and a nickel alloy, for example. Meanwhile, as illustrated in FIGS. 4 and 5, the holding member 2 is not disposed sideways of the elastic members 4, or in other words, at a position in the y1 direction relative to the elastic members 4. The holding member 2 is located at a position in the z2 direction relative to the elastic members 4. The elastic members 4 will be described later in detail.

1-2c. Fixing Members 3

The fixing members 3 illustrated in FIGS. 2 to 5 are used for fixing the liquid ejecting heads 1 to the holding member 2. The use of the fixing members 3 makes it possible to fix the liquid ejecting heads 1 to the holding member 2 easily without using any screws as in the related art. The fixing members 3 will be described later in detail.

1-2d. Liquid Ejecting Head 1

As illustrated in FIGS. 3 to 5, the liquid ejecting head 1 has the ejecting surface S11 provided with the nozzles for ejecting the ink. As illustrated in FIG. 4, the liquid ejecting head 1 is held by the holding member 2 such that the ejecting surface S11 is located in the front line in the z1 direction among the constituents of the head unit 10.

Figure 6:
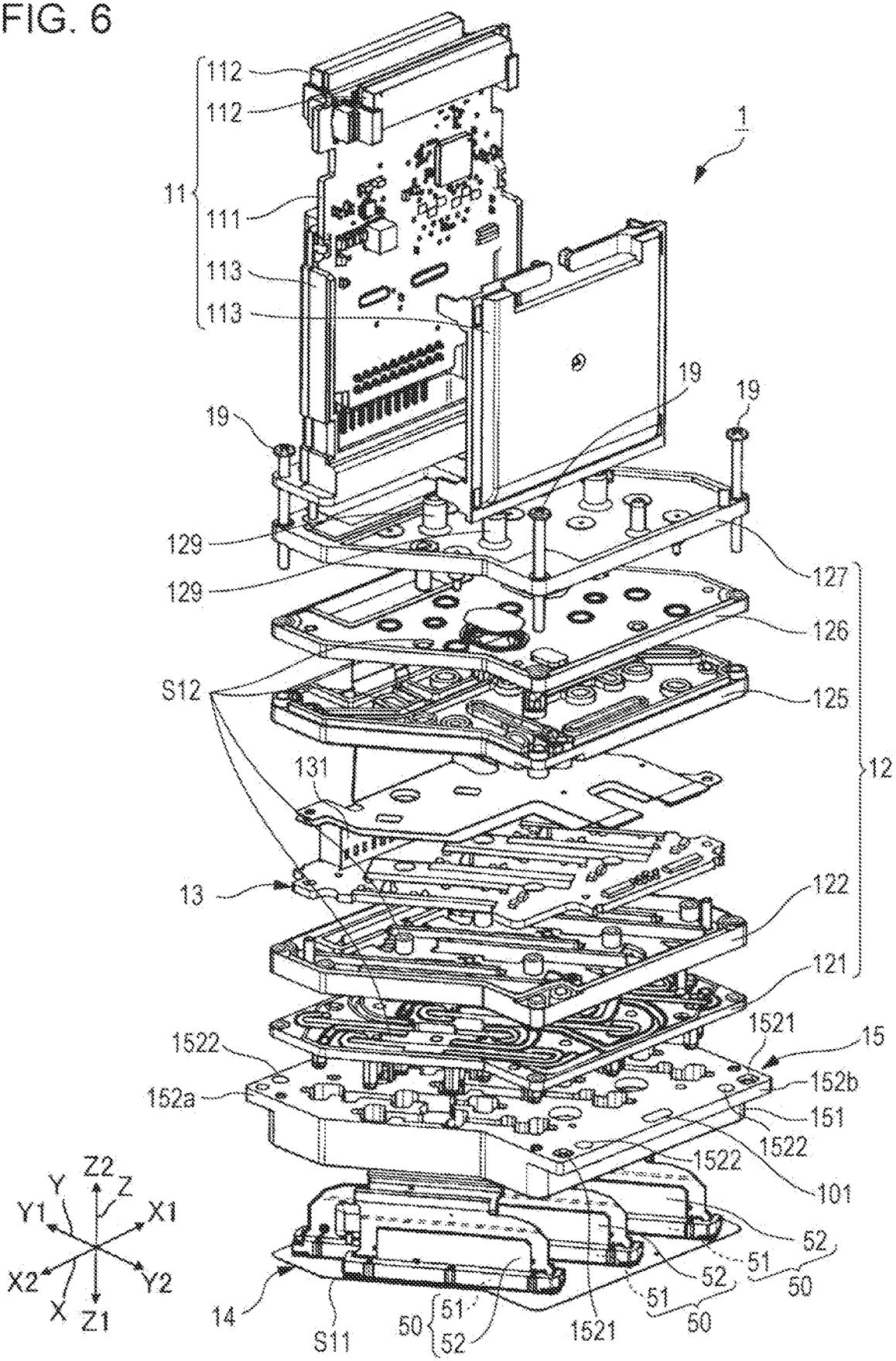
FIG. 6 is an exploded perspective view of a liquid ejecting head illustrated in FIG. 4.

FIG. 6 is an exploded perspective view of the liquid ejecting head 1 illustrated in FIG. 4. As illustrated in FIG. 6, the liquid ejecting head 1 includes an electric coupling portion 11, a flow channel structure 12, a wiring substrate 13, head chips 50, a fixation plate 14, and a holder 15. These elements are stacked on one another and fastened together with screws 19.

As illustrated in FIG. 6, the electric coupling portion 11 includes a relay substrate 111, two connectors 112, and two covers 113. The relay substrate 111 is electrically coupled to the head chips 50 through the wiring substrate 13. The relay substrate 111 is provided with coupling terminals and various wires. The relay substrate 111 is a rigid substrate, for example. The relay substrate 111 is disposed on the wiring substrate 13 such that its plate surface extends in the z1 direction.

Meanwhile, the connectors 112 are coupled to the relay substrate 111. The connectors 112 are used for establishing electric coupling to the outside of the liquid ejecting head 1. Meanwhile, the relay substrate 111 is sandwiched between the two covers 113 and protected by the two covers 113. One of the two covers 113 covers a surface in the y1 direction of the relay substrate 111 while the other cover 113 covers a surface in the y2 direction of the relay substrate 111.

The flow channel structure 12 is disposed at a position in the z1 direction relative to the electric coupling portion 11. The flow channel structure 12 includes flow channel substrates 121, 122, 125, 126, and 127. The flow channel substrates 121, 122, 125, 126, and 127 are arranged in this order in the z2 direction.

The flow channel substrate 127 is provided with flow channel pipes 129 that project in the z2 direction. The flow channel pipes 129 are used for coupling with not-illustrated tubes and the like to be coupled to the circulation mechanism 92 illustrated in FIG. 1. Through holes and recesses are formed in the flow channel substrates 121, 122, 125, and 126. Flow channels S12 in which the ink flows are formed from the through holes and the recesses. The flow channels S12 include flow channels that supply the ink from the circulation mechanism 92 illustrated in FIG. 1 to the head chips 50 illustrated in FIG. 6, and flow channels that return the ink discharged from the head chips 50 to the circulation mechanism 92.

Here, the number of the flow channel substrates included in the flow channel structure 12 is not limited to 5. The number of the flow channel substrates may be in a range from 1 to 4 or equal to or above 6. Meanwhile, the material of each of the flow channel substrates 121, 122, 125, 126, and 127 is one of a metal such as stainless steel (SUS) and aluminum, a ceramic, and a resin such as poly(p-phenylene benzobisoxazole) and polypropylene.

The wiring substrate 13 is disposed between the components of the flow channel structure 12. In the example illustrated in FIG. 6, the wiring substrate 13 is disposed between the flow channel substrate 122 and the flow channel substrate 125. The wiring substrate 13 is a mounted component for electrically coupling the relay substrate 111 to the head chips 50. The wiring substrate 13 is a rigid substrate, for example. Meanwhile, the wiring substrate 13 is provided with connector 131 which serves as a coupling component to be coupled to the relay substrate 111.

The head chips 50 are disposed at positions in the z1 direction relative to the flow channel structure 12. Each head chip 50 includes nozzles. Moreover, each head chip 50 includes a mechanism for ejecting the ink from the nozzles. Specifically, each head chip 50 includes an actuator unit 51 and a wiring member 52.

The actuator unit 51 includes a nozzle plate provided with the nozzle, a flow channel member includes a flow channel that communicates with the nozzle, a pressure chamber substrate includes a pressure chamber that communicates with the flow channel, a vibration plate for changing a pressure inside the pressure chamber, and a piezoelectric element that vibrates the vibration plate. Meanwhile, the piezoelectric element includes a piezoelectric body and an electrode. The electrode is electrically coupled to the wiring member 52. In the meantime, the actuator unit 51 forms part of the ejecting surface S11 provided with the nozzle.

The wiring member 52 includes a driving circuit for driving the piezoelectric element included in the actuator unit 51. The wiring member 52 is a chip on film (COF), for example. The wiring member 52 electrically couples the piezoelectric element included in the actuator unit 51 to the wiring substrate 13. The piezoelectric element included in the actuator unit 51 is driven in response to a driving signal from the control unit 93 illustrated in FIG. 1.

As illustrated in FIG. 6, the fixation plate 14 is a plate-like member for fixing the head chips 50 to the holder 15. The fixation plate 14 includes openings for exposing the nozzles included in the head chips 50. A surface in the z1 direction of the fixation plate 14 forms a bottom surface of the liquid ejecting head 1. The bottom surface forms part of the ejecting surface S11. The ejecting surface S11 is formed from the bottom surface of the fixation plate 14 and a bottom surface of the actuator unit 51. The material of the fixation plate 14 is a metal such as stainless steel.

The holder 15 is disposed at a position in the z1 direction relative to the flow channel structure 12. The holder 15 has a prescribed thickness in the z1 direction. The holder 15 holds the fixation plate 14 and the head chips 50. The material of the holder 15 is stainless steel, for example. Instead, the material of the holder 15 may be any of a metal other than the stainless steel, a resin, and the like.

The holder 15 includes a base portion 151, a first flange portion 152*a*, and a second flange portion 152*b*. The base portion 151 is a plate-like portion extending along x-y plane. The base portion 151 includes recesses for housing the head chips 50. Moreover, the base portion 151 includes through holes that continue from the recesses and penetrate the base portion 151 in the z1 direction. The wiring member 52 is inserted into each through hole.

The first flange portion 152*a* is a portion that bulges in the y1 direction from the base portion 151. The second flange portion 152*b* is a portion that bulges in the y2 direction from the base portion 151. The first flange portion 152*a* and the second flange portion 152*b* have an elongate shape of which longitudinal direction is in line with the x1 direction. The first flange portion 152*a* and the second flange portion 152*b* are used for fixing the liquid ejecting head 1 to the above-mentioned holding member 2.

Meanwhile, as illustrated in FIG. 5, the first flange portion 152*a* includes an opening 101 having a second opening 102, and a pair of fixation holes 1522. Details of the second opening 102 will be described later. The opening 101 is disposed between the pair of fixation holes 1522 in the x1 direction.

Meanwhile, as illustrated in FIG. 6, the second flange portion 152*b* includes an opening 101 having a second opening 102, a pair of positioning holes 1521, and a pair of fixation holes 1522. Then opening 101 is disposed between the pair of fixation holes 1522 in the x1 direction. Meanwhile, the pair of fixation holes 1522 are disposed between the pair of positioning pins 211 in the x1 direction. The positioning holes 1521 are provided corresponding to the positioning pins 211 illustrated in FIG. 3. The positioning pins 211 are inserted into the respective positioning holes 1521. Insertion of the positioning pins 211 into the positioning holes 1521 makes it possible to position the liquid ejecting head 1 relative to the holding member 2 before the liquid ejecting head 1 is fixed to the holding member 2.

This embodiment does not adopt a fastening method by using screws provided with spiral threads for fixation of the liquid ejecting head 1 to the holding member 2. Accordingly, the fixation holes 1522 are not used in this embodiment. However, by providing the liquid ejecting head 1 with the fixation holes 1522 that allow insertion of the screws as described above, it is possible to apply a fixation method using screw fastening to a holding member that includes threaded grooves unlike the holding member in this embodiment.

1.3. Configuration Concerning Fixation of Liquid Ejecting Head 1 to Holding Member 2

Figure 7:
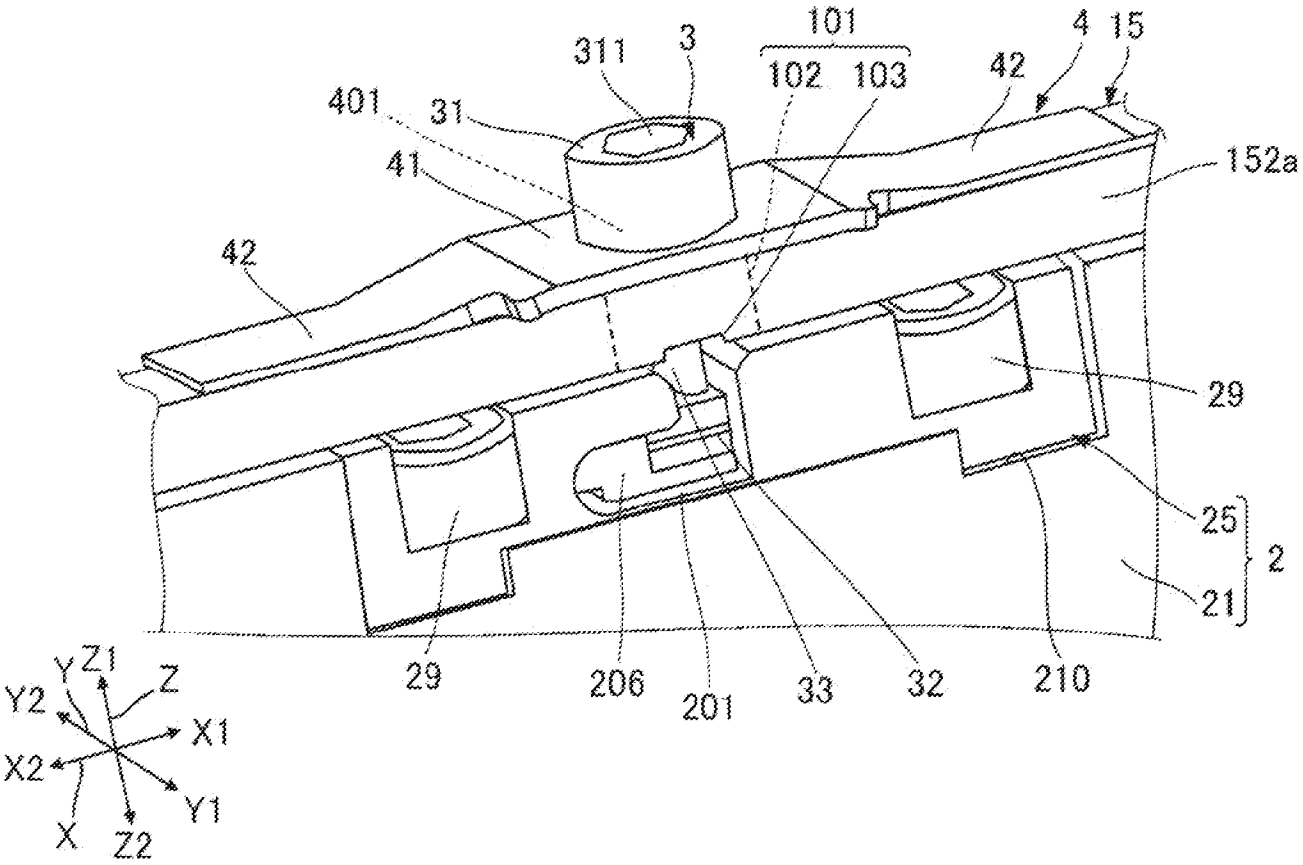
FIG. 7 is an enlarged diagram of a fixing member, an elastic member, the liquid ejecting head, and a holding member illustrated in FIG. 5.
Figure 8:
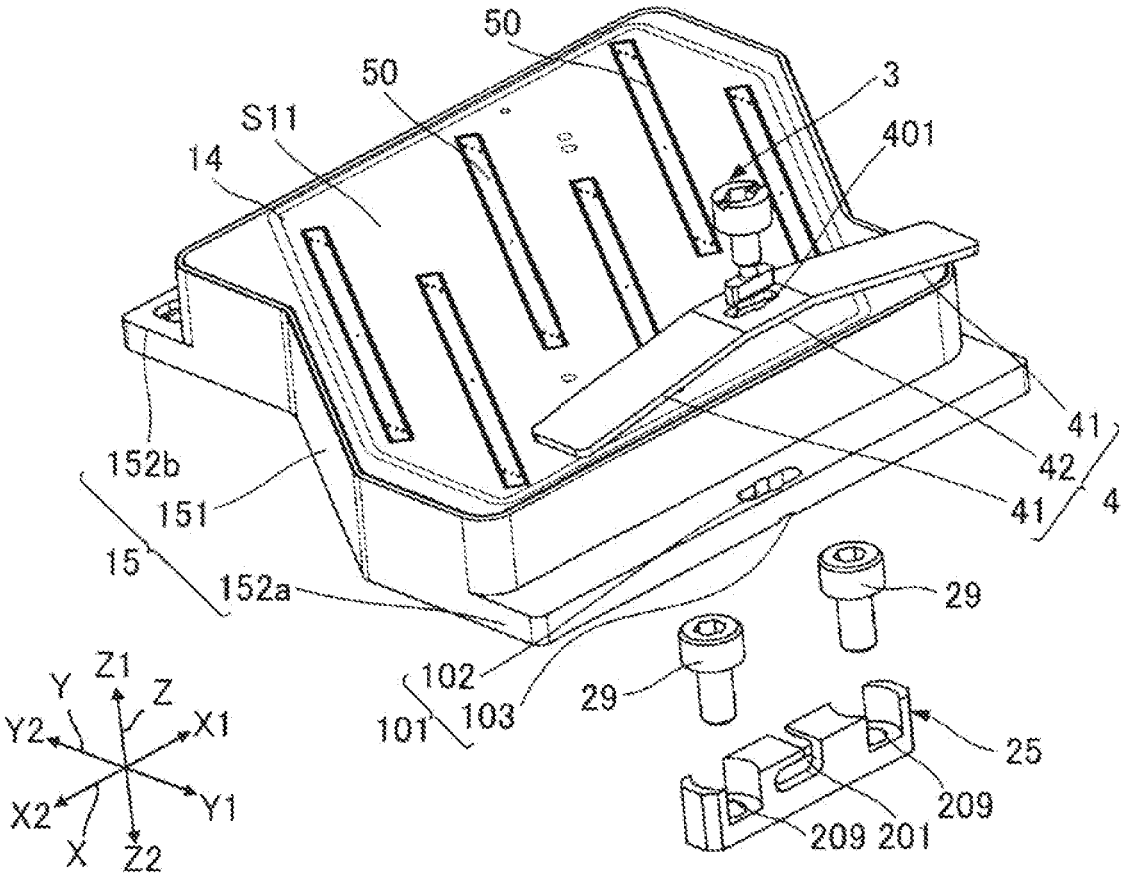
FIG. 8 is an exploded perspective view of the fixing member, the elastic member, the liquid ejecting head, and the holding member illustrated in FIG. 5.
Figure 9:
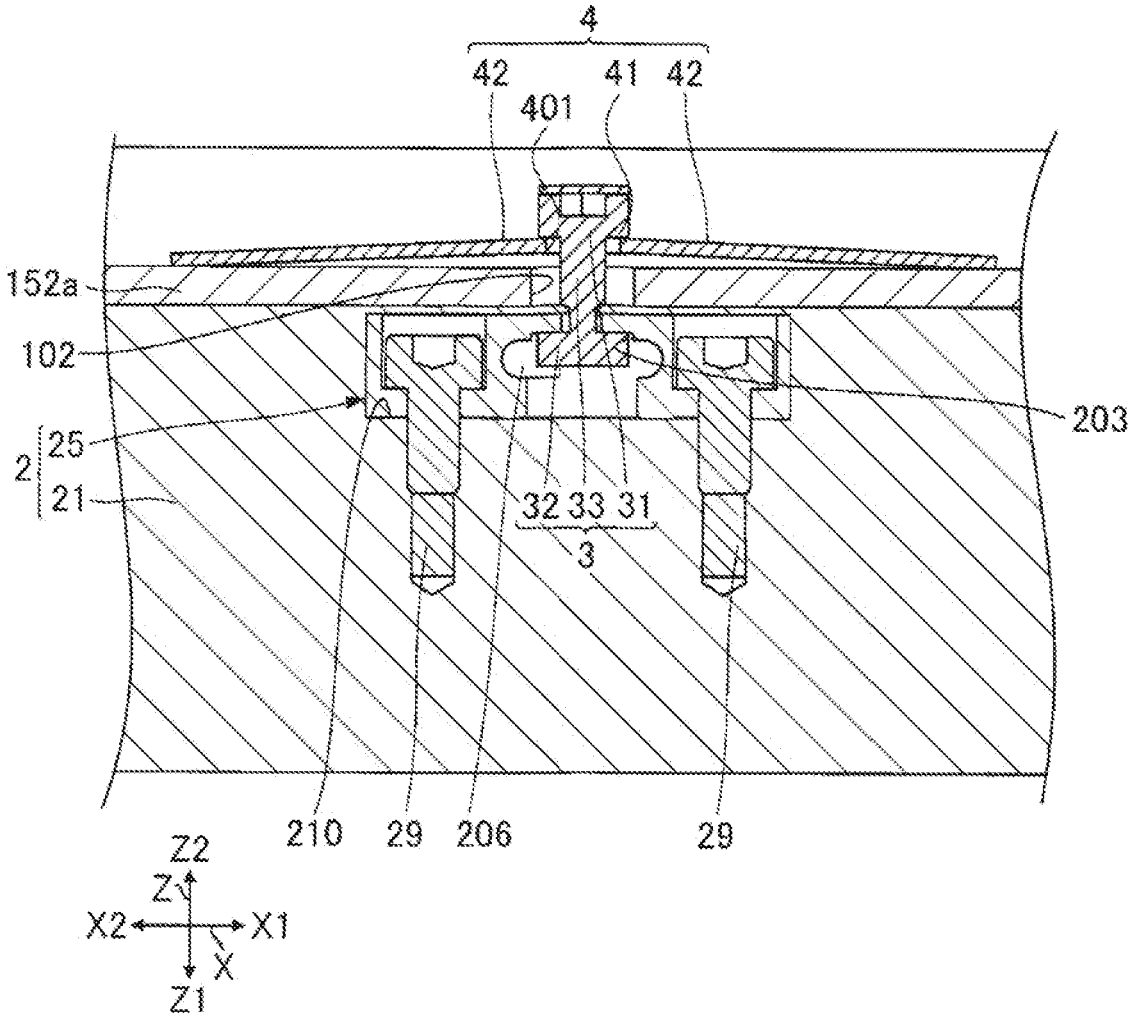
FIG. 9 is a cross-sectional view of the fixing member, the elastic member, the liquid ejecting head, and the holding member illustrated in FIG. 5.

FIG. 7 is an enlarged diagram of the fixing member 3, the elastic member 4, the liquid ejecting head 1, and the holding member 2 illustrated in FIG. 5. FIG. 8 is an exploded perspective view of the fixing member 3, the elastic member 4, the liquid ejecting head 1, and the holding member 2 illustrated in FIG. 5. FIG. 9 is a cross-sectional view of the fixing member 3, the elastic member 4, the liquid ejecting head 1, and the holding member 2 illustrated in FIG. 5. Note that illustration of the fixation holes 1522 will be omitted in FIGS. 7 to 9 as appropriate.

As illustrated in FIGS. 7 to 9, the elastic member 4, the liquid ejecting head 1, and the holding member 2 are arranged in this order in the z1 direction. The liquid ejecting head 1 is fixed to the holding member 2 by using the fixing member 3. Specifically, the first flange portion 152*a* and the second flange portion 152*b* of the holder 15 included in the liquid ejecting head 1 are fixed to the engaged member 25 included in the holding member 2. A description will be given below of the fixing member 3 concerning the fixation of the liquid ejecting head 1 to the holding member 2, the elastic member 4, the liquid ejecting head 1, and the holding member 2 by using the after-mentioned FIGS. 10 to 20 with reference to FIGS. 7 to 9. Note that the first flange portion 152*a* and the second flange portion 152*b* have the same configuration. Accordingly, details concerning the first flange portion 152*a* will be representatively described below and a description of details concerning the second flange portion 152*b* will be omitted as appropriate.

Figure 10:
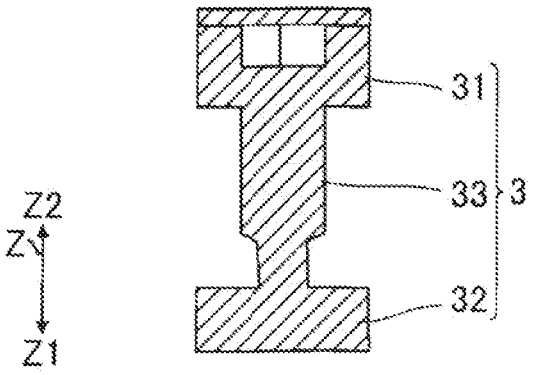
FIG. 10 is a cross-sectional view of the fixing member illustrated in FIG. 7.

FIG. 10 is a cross-sectional view of the fixing member 3 illustrated in FIG. 7. The fixing member 3 illustrated in FIG. 10 is used for fixing the liquid ejecting head 1 to the engaged member 25 of the holding member 2. The material of the fixing member 3 is a metal such as aluminum and stainless steel.

As illustrated in FIG. 10, the fixing member 3 includes a head portion 31, an engaging portion 32, and a shaft portion 33. The shaft portion 33 couples the head portion 31 to the engaging portion 32.

In the example illustrated in FIGS. 7 and 8, the shape of the head portion 31 is substantially a columnar shape. Instead, the head portion 31 may take on a prismatic shape, for example. The shaft portion 33 is an elongate portion. Meanwhile, the engaging portion 32 is another elongate portion. Here, a length in a longitudinal direction of the engaging portion 32 is smaller than a length in a longitudinal direction of the shaft portion 33. Moreover, the longitudinal direction of the shaft portion 33 intersects with the longitudinal direction of the engaging portion 32. In the example illustrated in FIGS. 7 and 8, the longitudinal direction of the shaft portion 33 is orthogonal to the longitudinal direction of the engaging portion 32.

The head portion 31 is a portion that comes into contact with the elastic member 4. In this embodiment, the head portion 31 functions as an operating portion for performing a rotating operation of the fixing member 3 in the x-y plane with respect to the liquid ejecting head 1 when fixing the liquid ejecting head 1. Meanwhile, engaging portion 32 is a portion to engage with the holding member 2. In this embodiment, the engaging portion 32 is formed to be fittable into the first flange portion 152*a* and the engaged member 25, respectively. In a state where the first flange portion 152*a* is fixed to the engaged member 25 as illustrated in FIG. 7, the engaging portion 32 is fitted into the engaged member 25. To be more precise, the fixing member 3 is fitted into the engaged member 25 in a state where the elastic member 4 and the first flange portion 152*a* are located between the head portion 31 and the engaging portion 32. Meanwhile, the shaft portion 33 has a length that corresponds to a length in the z1 direction of the elastic member 4 and the first flange portion 152*a*.

Figure 11:
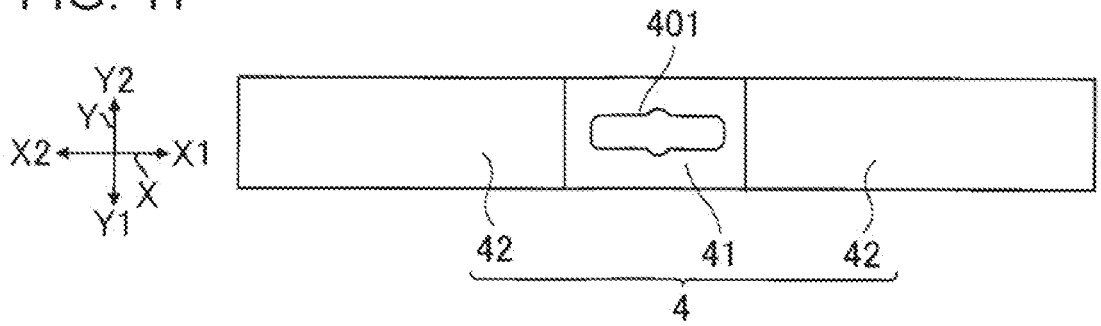
FIG. 11 is a plan view of the elastic member illustrated in FIG. 7.

FIG. 11 is a plan view of the elastic member 4 illustrated in FIG. 7. The elastic member 4 illustrated in FIG. 11 is a spring member having elasticity. By providing the elastic member 4, it is possible to increase fixation stability when fixing the liquid ejecting head 1 to the holding member 2 or when using the liquid ejecting apparatus 100 as compared to a case without providing the elastic member 4.

As illustrated in FIGS. 7 to 9, and 11, the elastic member 4 is a plate spring having an elongated flat plate shape, and the elastic member 4 is partially bent. The elastic member 4 comes into contact with the head portion 31 of the fixing member 3 in a state where the liquid ejecting head 1 is fixed to the holding member 2 by using the fixing member 3.

The elastic member 4 has elasticity. The elastic member 4 includes a base portion 41 and two spring portions 42. The base portion 41 is a portion located between the two spring portions 42. The spring portions 42 are elastically deformable along the z axis.

Meanwhile, the base portion 41 includes a first opening 401 into which the shaft portion 33 is inserted. The first opening 401 is a wall portion that forms a hole to penetrate the base portion 41 of the elastic member 4. As illustrated in FIG. 11, a shape in plan view of the hole defined by the first opening 401 is a shape in conformity to a longitudinal direction of the elastic member 4. The hole defined by the first opening 401 corresponds to the shaft portion 33 and the engaging portion 32 of the fixing member 3, and is formed such that the shaft portion 33 and the engaging portion 32 can be inserted into the hole. Meanwhile, as illustrated in FIGS. 7 and 8, a shape in plan view of the elastic member 4 corresponds to a shape in plan view of the first flange portion 152*a*. A length in the longitudinal direction of the elastic member 4 is equal to or below a length in a longitudinal direction of the first flange portion 152*a*.

Figure 12:
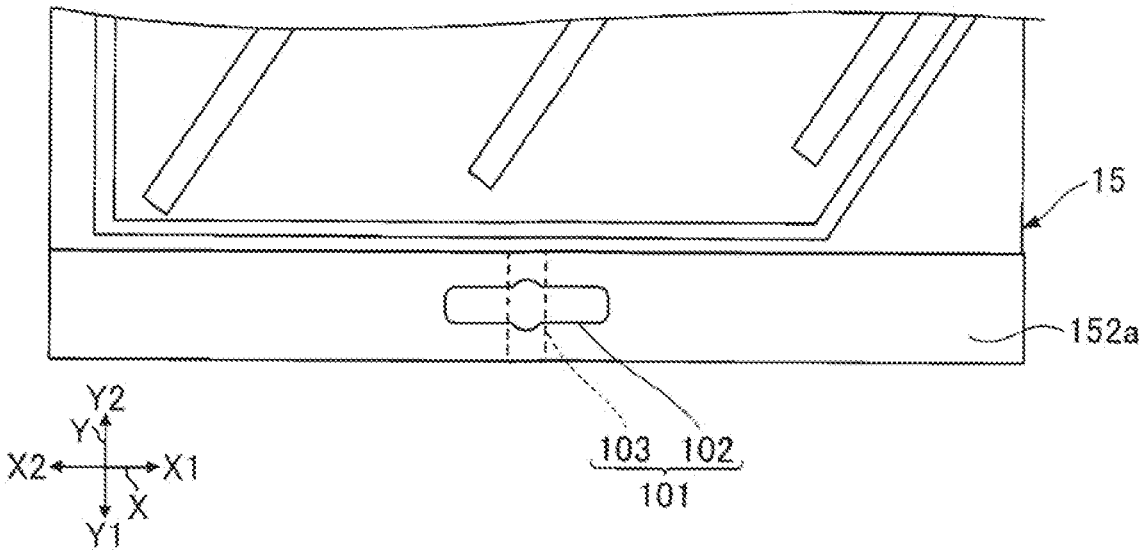
FIG. 12 is a plan view of a first flange portion included in a holder illustrated in FIG. 7.

FIG. 12 is a plan view of the first flange portion 152*a* included in the holder 15 illustrated in FIG. 7. The first flange portion 152*a* illustrated in FIG. 12 is used for fixing the holder 15 of the liquid ejecting head 1 to the engaged member 25.

As illustrated in FIGS. 7 and 12, the first flange portion 152*a* of the liquid ejecting head 1 includes the opening 101 into which the shaft portion 33 is inserted. The opening 101 includes the second opening 102 and a second engaged portion 103.

The second opening 102 is a wall portion that forms a hole to penetrate the first flange portion 152*a*. As illustrated in FIG. 12, a shape in plan view of the hole defined by the second opening 102 is a shape in conformity to a longitudinal direction of the first flange portion 152*a*. The hole defined by the second opening 102 corresponds to the shaft portion 33 and the engaging portion 32 of the fixing member 3, and is formed such that the shaft portion 33 and the engaging portion 32 can be inserted into the hole.

As illustrated in FIG. 7, the second engaged portion 103 is located at a position in the z2 direction relative to the second opening 102. The second engaged portion 103 is a wall portion that forms a groove open to a surface in the z2 direction of the first flange portion 152*a*. The groove defined by the second engaged portion 103 communicates with the hole defined by the second opening 102. Moreover, as illustrated in FIG. 12, the groove defined by the second engaged portion 103 extends in the y1 direction in plan view, and intersects with the hole defined by the second opening 102. In the example illustrated in FIG. 12, the groove defined by the second engaged portion 103 is orthogonal to the hole defined by the second opening 102 in plan view.

Figure 13:
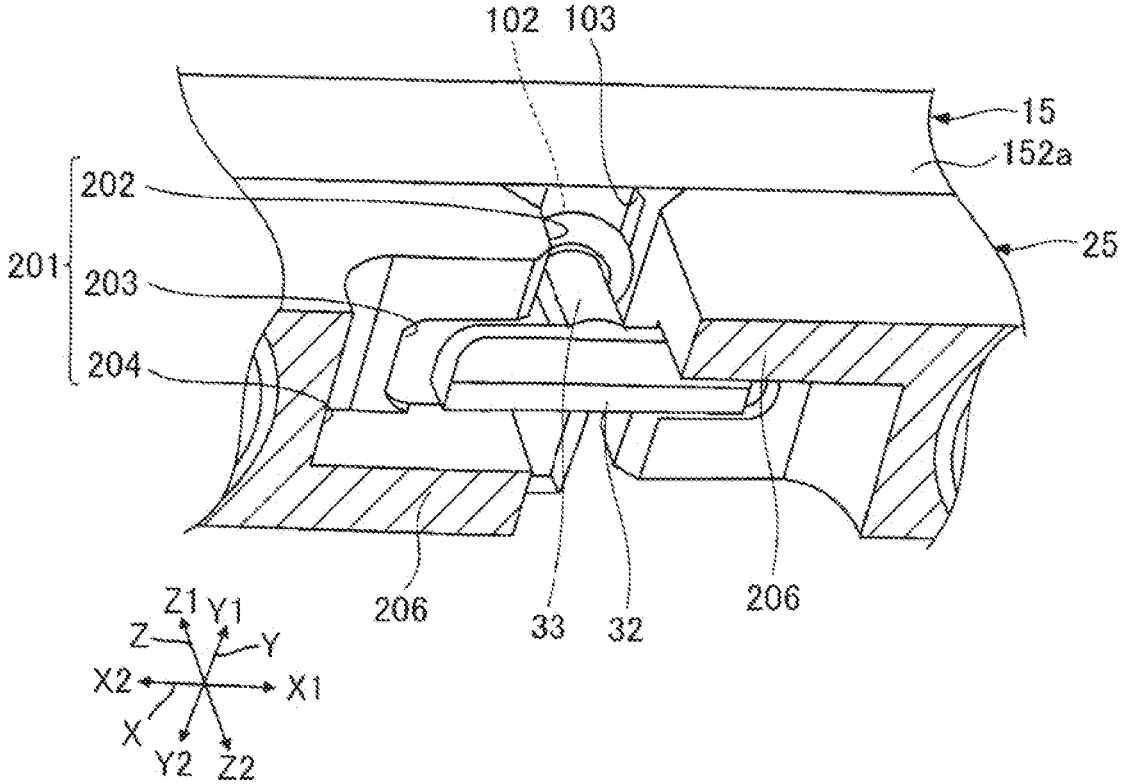
FIG. 13 is a perspective view of an engaged member illustrated in FIG. 7.
Figure 14:
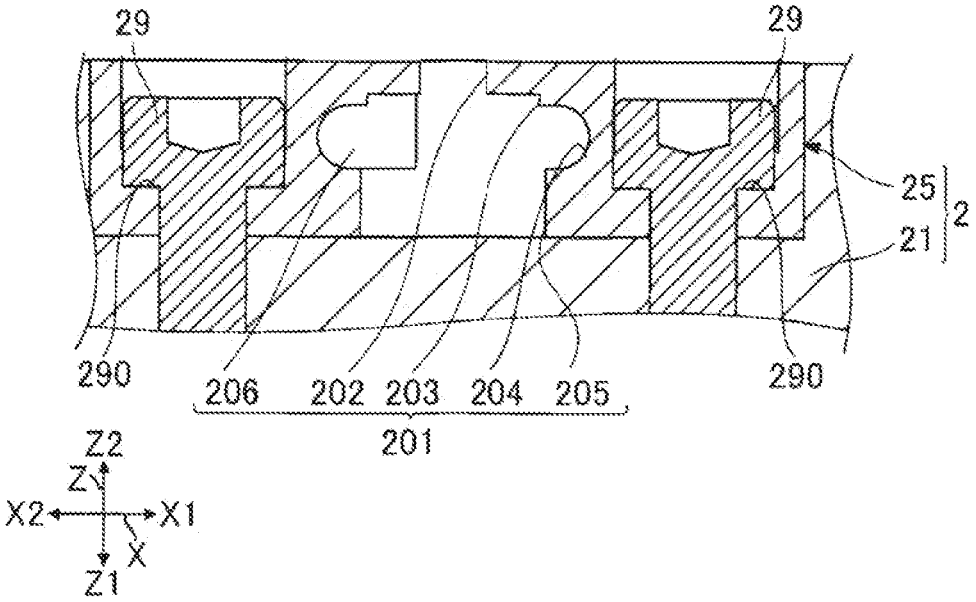
FIG. 14 is a cross-sectional view of the engaged member illustrated in FIG. 7.
Figure 15:
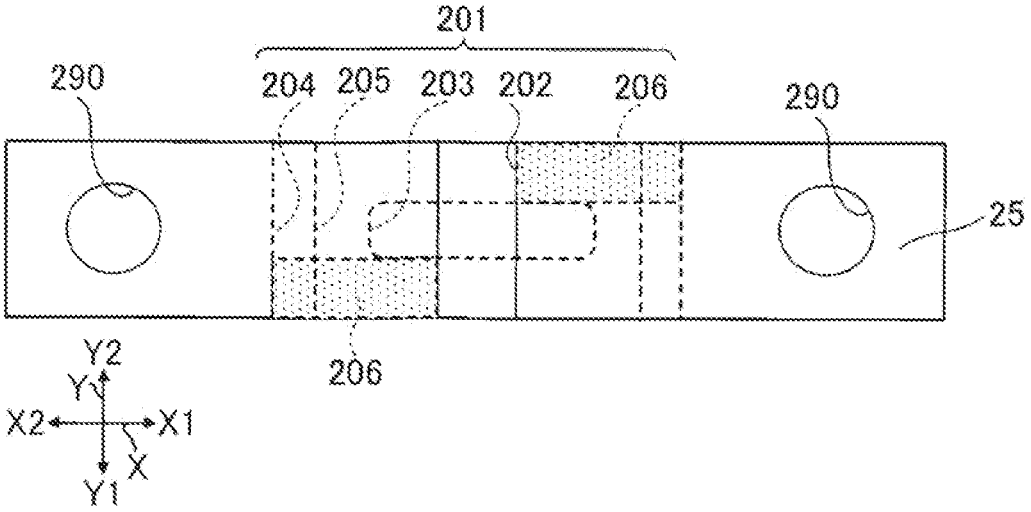
FIG. 15 is a plan view of the engaged member illustrated in FIG. 7.

FIG. 13 is a perspective view of the engaged member 25 illustrated in FIG. 7. FIG. 14 is a cross-sectional view of the engaged member 25 illustrated in FIG. 7. FIG. 15 is a plan view of the engaged member 25 illustrated in FIG. 7. The engaged member 25 illustrated in FIGS. 13 to 15 is a member to be engaged with the engaging portion 32 of the fixing member 3. The material of the engaged member 25 is aluminum, for example. Here, the material of the engaged member 25 may be either a metal other than aluminum or a resin.

As illustrated in FIGS. 7 and 9, the engaged member 25 is disposed in the recess 210 of the body portion 21. A surface in the z1 direction of the body portion 21 and a surface in the z1 direction of the engaged member 25 are located at the same position. Accordingly, a substantially flat surface is formed from the surface in the z1 direction of the body portion 21 and the surface in the z1 direction of the engaged member 25. As illustrated in FIGS. 14 and 15, the engaged member 25 includes two screw openings 290 and an opening 201. The opening 201 is located between the two screw openings 290 in plan view.

The two screw openings 290 are wall portions that form holes to penetrate the engaged member 25. A screw member 29 is inserted into each screw opening 290. A tip end of the screw member 29 is inserted into a screw hole formed in the body portion 21. Accordingly, the engaged member 25 that is provided separately from the body portion 21 is fixed to the body portion 21 by using the screw members 29. Thus, the engaged member 25 is attachable to and detachable from the body portion 21. Since the engaged member 25 is attachable and detachable, the engaged member 25 can be replaced easily when the engaged member 25 develops scratches as a consequence of repeating replacement of the liquid ejecting heads 1 or when the engaged member 25 causes ink adhesion and the like.

The opening 201 is a wall portion that forms a hole to penetrate the engaged member 25 in the z1 direction. The opening 201 includes a third opening 202, a first engaged portion 203, a fourth opening 204, a fifth opening 205, and regulating portions 206.

As illustrated in FIG. 14, the third opening 202, the first engaged portion 203, the fourth opening 204, and the fifth opening 205 collectively form part of a hole to penetrate the engaged member 25 in the z1 direction. The third opening 202, the first engaged portion 203, the fourth opening 204, and the fifth opening 205 are arranged in this order in the z1 direction. Respective holes formed by the third opening 202, the first engaged portion 203, the fourth opening 204, and the fifth opening 205 communicate with one another.

As illustrated in FIG. 15, a shape in plan view of the hole defined by the third opening 202 is a shape in conformity to the y1 direction being a width direction of the engaged member 25. The hole defined by the third opening 202 corresponds to the shaft portion 33 and the engaging portion 32 of the fixing member 3, and is formed such that the shaft portion 33 and the engaging portion 32 can be inserted into the hole. Moreover, the hole of the third opening 202 is open in the z2 direction of the engaged member 25.

As illustrated in FIG. 13, the first engaged portion 203 is also a groove formed in the engaged member 25. To be more precise, the first engaged portion 203 is a groove formed in a surface of the third opening 202 on an opposite side from a surface of the third opening 202 opposed to the second opening 102. The first engaged portion 203 is engaged with the engaging portion 32. As illustrated in FIG. 15, a shape in plan view of the groove defined by the first engaged portion 203 is a shape in conformity to a longitudinal direction of the engaged member 25. The groove defined by the first engaged portion 203 intersects with the hole defined by the third opening 202 in plan view. In the example illustrated in FIG. 13, the groove defined by the first engaged portion 203 is orthogonal to the hole defined by the third opening 202 in plan view. Moreover, the groove defined by the first engaged portion 203 corresponds to the engaging portion 32 of the fixing member 3, and is formed such that the engaging portion 32 can be inserted to the groove.

As illustrated in FIGS. 13 and 15, the hole defined by the fourth opening 204 is open in the y1 direction and the y2 direction of the engaged member 25. A length in the x1 direction of the hole defined by the fourth opening 204 is larger than a length in the x1 direction of the first engaged portion 203. Meanwhile, the hole defined by the fifth opening 205 is open in the z1 direction of the engaged member 25 and open in the y1 direction and the y2 direction of the engaged member 25. A length in the x1 direction of the hole defined by the fifth opening 205 is smaller than a length in the x1 direction of the fourth opening 204. Here, the fourth opening 204 and the first engaged portion 203 may be collectively regarded as the "first engaged portion", or the fifth opening 205, the fourth opening 204, and the first engaged portion 203 may be collectively regarded as the "first engaged portion".

As illustrated in FIGS. 13 and 15, the two regulating portions 206 are wall portions provided to the fourth opening 204. One of the two regulating portions 206 is located at a position in the y1 direction relative to the first engaged portion 203 in plan view while the other regulating portion 206 is located at a position in the y2 direction relative to the first engaged portion 203 in plan view. Moreover, the two regulating portions 206 are point-symmetrically disposed with respect to the center in plan view of the groove defined by the first engaged portion 203. These regulating portions 206 regulate rotation in the x-y plane of the engaging portion 32 of the fixing member 3.

As described above, the liquid ejecting apparatus 100 includes the liquid ejecting head 1, the holding member 2, the elastic member 4, and the fixing member 3. Moreover, the liquid ejecting head 1 is fixed to the holding member 2 by the engaging portion 32 being brought into engagement with the first engaged portion 203 such that the first opening 401 included in the elastic member 4 and the second opening 102 included in the liquid ejecting head 1 are disposed between the head portion 31 and the engaging portion 32 included in the fixing member 3. In this way, it is possible to fix the liquid ejecting head 1 to the holding member 2 easily without using the screws as in the related art. Hence, it is possible to attach and replace the liquid ejecting head 1 easily.

When using the screws as in the related art, it is necessary to conduct three operations at the same time, namely, an operation to press the liquid ejecting head 1 against the holding member 2, an operation to hold the screws, and an operation to fix the screws with a tool such as a screw driver. In contrast, the user of the fixing member 3 makes it possible to fix the liquid ejecting head 1 to the holding member 2 easily by conducting an operation to rotate the fixing member 3 in the x-y plane while holding the liquid ejecting head 1. Thus, this embodiment reduces the number of operations as compared to the related art, so that the attachment and replacement of the liquid ejecting head 1 can be carried out easily.

In addition, the liquid ejecting apparatus 100 includes the elastic members 4. Thus, it is possible to stably fix the liquid ejecting head 1 to the holding member 2 by using elastic force of the elastic members 4 as compared to the case of not providing the elastic members 4. Accordingly, although the screw fastening of the related art cannot stabilize the liquid ejecting head 1 over time due to loosening of the screws, the fixation using the fixing members 3 can maintain the state of stable fixation of the liquid ejecting head 1 for a long period. Moreover, the use of the fixing members 3 and the elastic members 4 can reduce the number of locations to be fixed. Accordingly, it is possible to significantly reduce time required for the fixation work. Furthermore, it is possible to fix the liquid ejecting head 1 easily to the holding member 2 by using the fixing members 3. Accordingly, the liquid ejecting head 1 can be fixed to the holding member 2 without dropping the liquid ejecting head 1, the fixing members 3, and the like even in a state where the liquid ejecting head 1 is located below the holding member 2 in the gravitational direction, or in other words, in a state where liquid ejecting head 1 cannot be placed on the holding member 2.

1-4. Method of Fixing Liquid Ejecting Head 1 to Holding Member 2

A method of manufacturing the liquid ejecting apparatus 100 includes the steps of preparing the liquid ejecting head 1, the holding member 2, the elastic members 4, and the fixing members 3, and fixing the liquid ejecting head 1 to the holding member 2. In the following, a method of fixing the liquid ejecting head 1 to the holding member 2 will be described. The method of fixing the liquid ejecting head 1 to the holding member 2 includes the steps of fixing the elastic member 4 to the liquid ejecting head 1, and fixing the liquid ejecting head 1 to the holding member 2.

Figure 16:
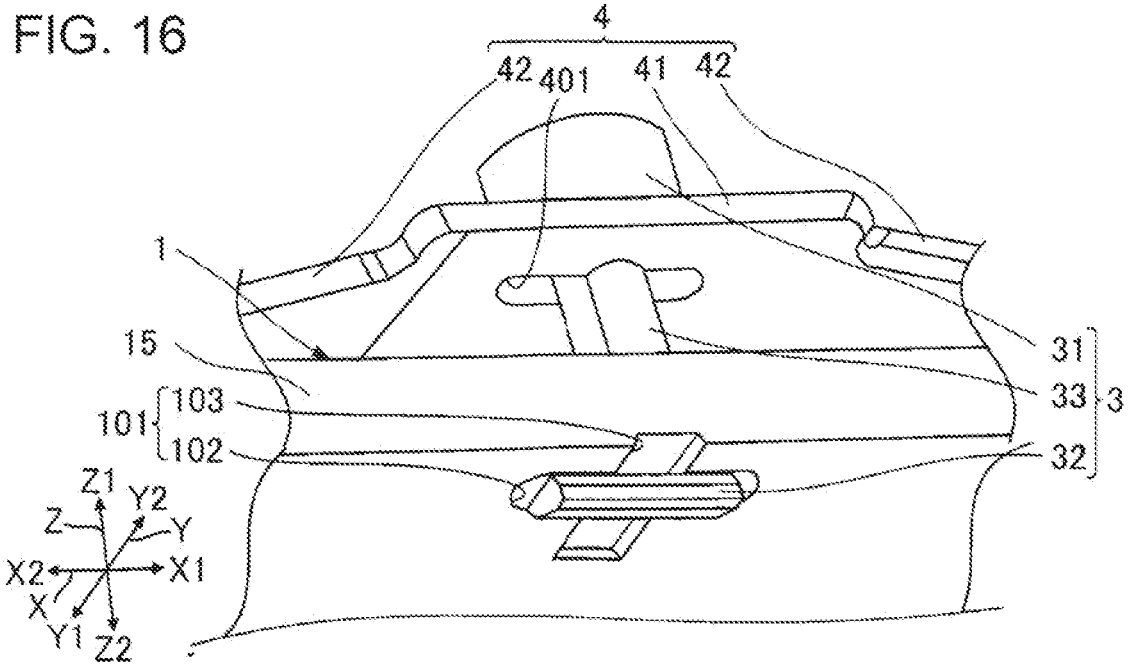
FIG. 16 is a diagram for explaining fixation of the elastic member to the liquid ejecting head.
Figure 17:
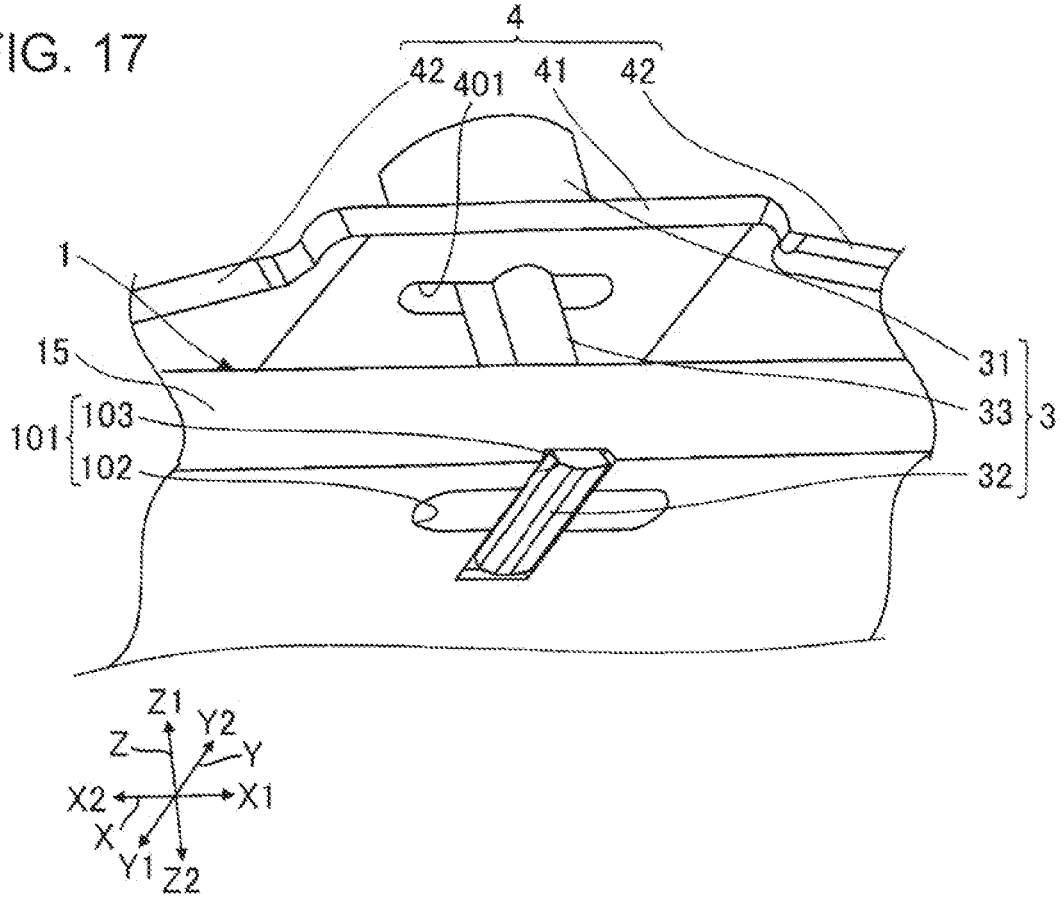
FIG. 17 is another diagram for explaining fixation of the elastic member to the liquid ejecting head.

Each of FIGS. 16 and 17 is a diagram for explaining fixation of the elastic member 4 to the liquid ejecting head 1. As illustrated in FIG. 16, the hole defined by the first opening 401 of the elastic member 4 is brought into a state of overlapping the hole defined by the second opening 102 of the liquid ejecting head 1 in plan view to begin with. Then, the engaging portion 32 and the shaft portion 33 of the fixing member 3 are inserted into the first opening 401 and the second opening 102.

In the state of inserting the shaft portion 33 into the first opening 401 and the second opening 102, the hole defined by the first opening 401, the hole defined by the second opening 102, and the engaging portion 32 overlap one another in plan view. From another point of view, a second position being a rotational position where the engaging portion 32 is insertable into the second opening 102 is the same as a rotational position where the engaging portion 32 is insertable into the first opening 401. For this reason, the fixing member 3 does not have to be rotated when inserting the fixing member 3 into the first opening 401 and the second opening 102 as illustrated in FIG. 16. In other words, it is possible to insert the engaging portion 32 of the fixing member 3 easily into the first opening 401 and the second opening 102 without rotating the fixing member 3.

Next, as illustrated in FIG. 17, the engaging portion 32 is brought into engagement with the second engaged portion 103 by rotating the fixing member 3 in the x-y plane. In this embodiment, the engaging portion 32 is rotated by 90° in the x-y plane by manipulating the head portion 31. The first opening 401 and the second opening 102 are located between the head portion 31 and the engaging portion 32 in the state of bringing the engaging portion 32 into engagement with the second engaged portion 103.

As described above, each of the first flange portion 152*a* and the second flange portion 152*b* of the liquid ejecting head 1 includes the second engaged portion 103 engageable with the engaging portion 32. Therefore, the elastic member 4 can be fixed to the liquid ejecting head 1 by bringing the engaging portion 32 into engagement with the second engaged portion 103. Accordingly, the elastic member 4 can be fixed to the liquid ejecting head 1 before fixing the liquid ejecting head 1 to the holding member 2. In other words, it is possible to bring the second engaged portion 103 of the liquid ejecting head 1 into engagement with the engaging portion 32 before bringing the first engaged portion 203 of the holding member 2 to be described later into engagement with the engaging portion 32. In this way, the elastic member 4 can be fixed to the liquid ejecting head 1 without dropping any of the liquid ejecting head 1 and the elastic member 4. Moreover, since the hole of the second opening 102 intersects with the groove of the second engaged portion 103 in plan view as described in this embodiment, the engaging portion 32 can be fitted into the second engaged portion 103.

Figure 18:
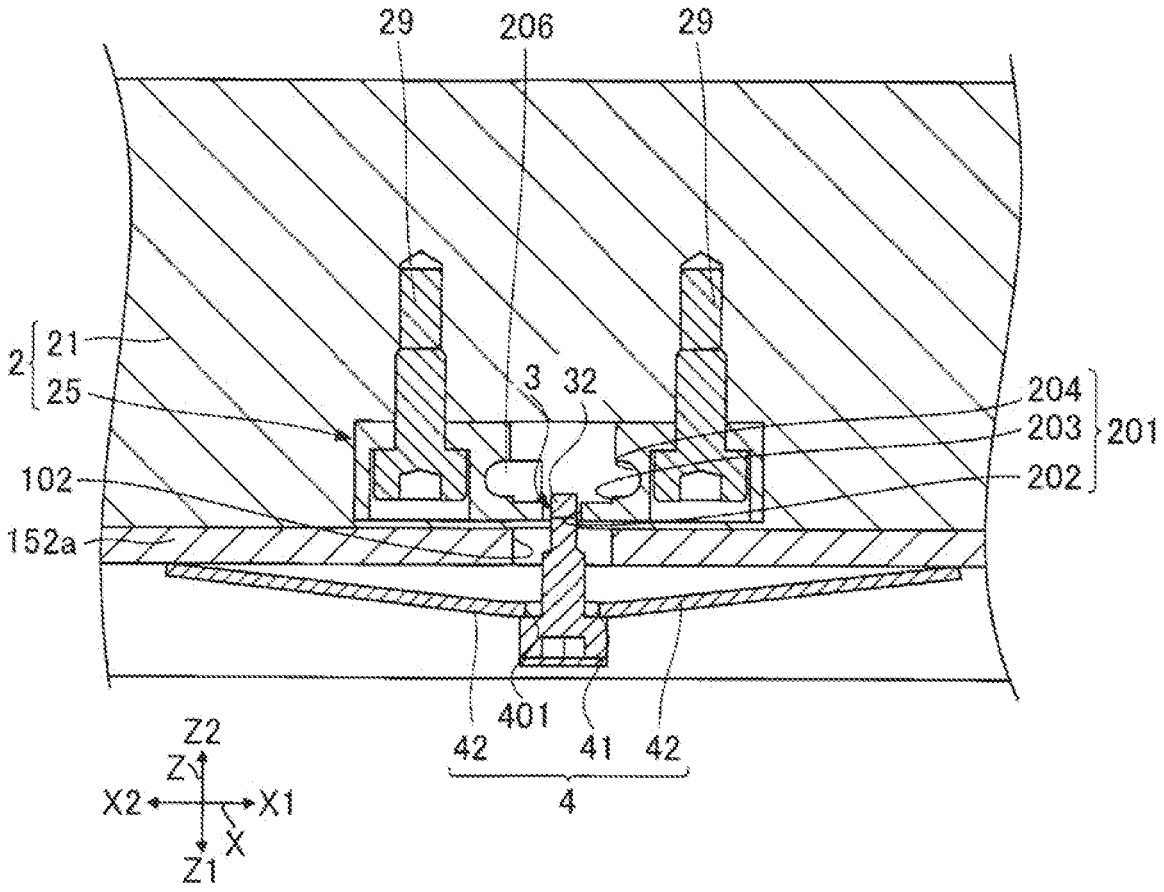
FIG. 18 is a diagram for explaining fixation of the liquid ejecting head to the holding member.
Figure 19:
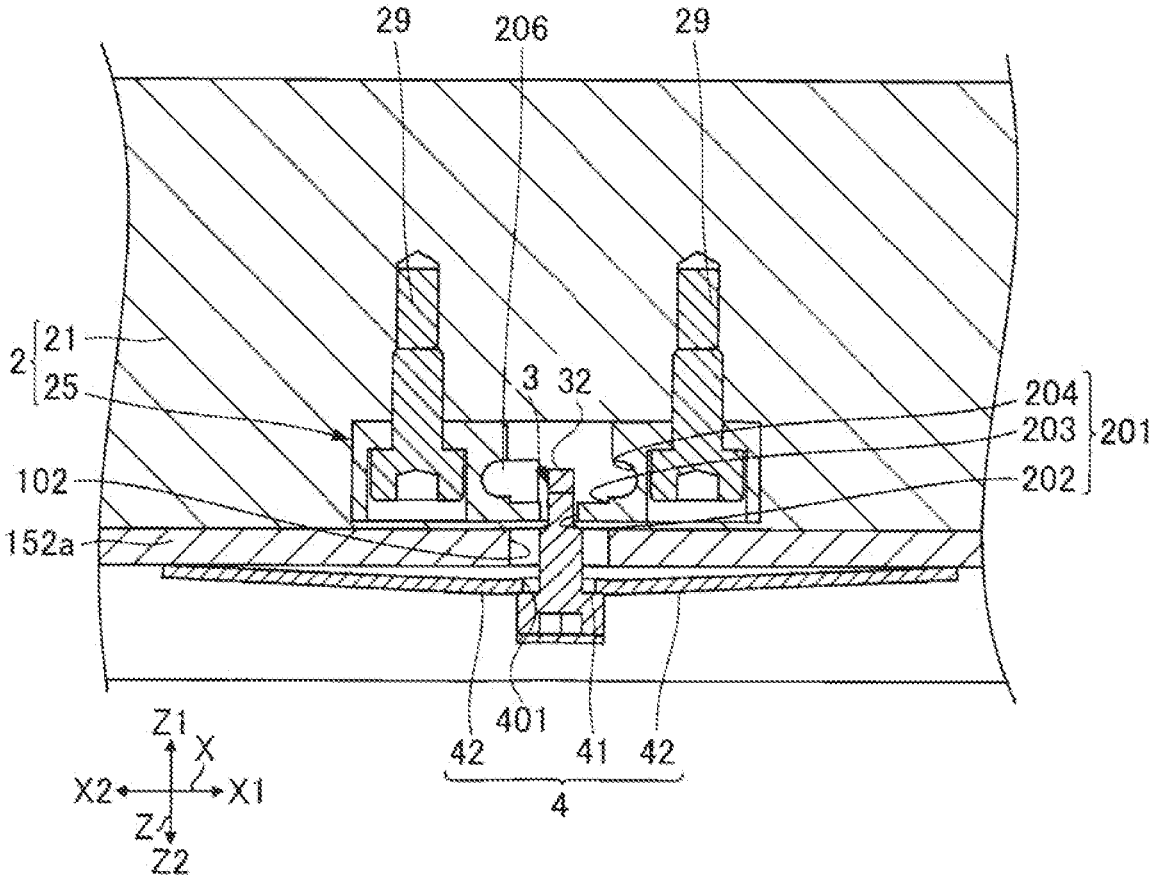
FIG. 19 is another diagram for explaining fixation of the liquid ejecting head to the holding member.
Figure 20:
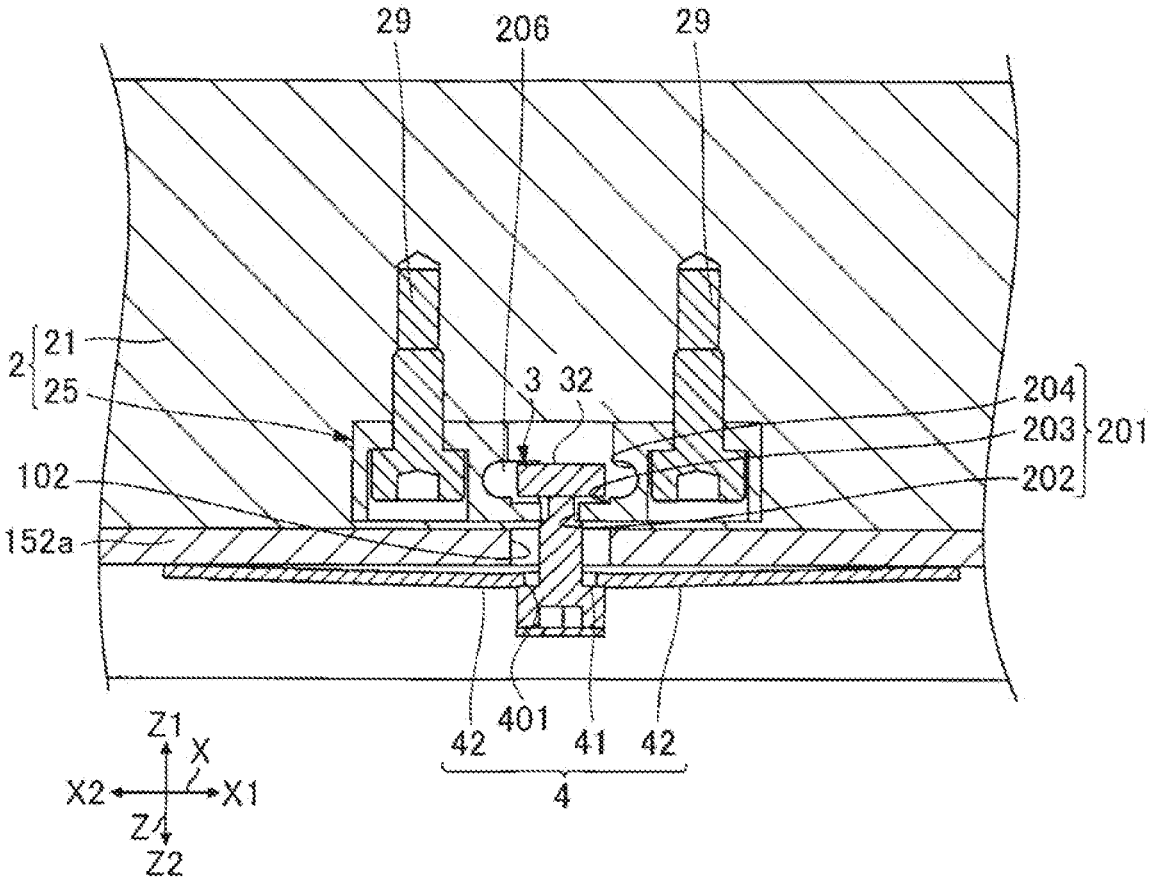
FIG. 20 is still another diagram for explaining fixation of the liquid ejecting head to the holding member.

Each of FIGS. 18, 19, and 20 is a diagram for explaining fixation of the liquid ejecting head 1 to the holding member 2. As illustrated in FIG. 18, the elastic member 4, the liquid ejecting head 1, and the holding member 2 are lapped over such that the first opening 401 is orthogonal to the third opening 202 in plan view by conducting positioning with the positioning pins 211 in a state where the elastic member 4 is fixed to the liquid ejecting head 1 by using the fixing member 3. In this lapped state, the engaging portion 32 of the fixing member 3 is inserted into the third opening 202 of the holding member 2 as illustrated in FIG. 18.

Next, as illustrated in FIG. 19, the fixing member 3 is pushed straight in the z2 direction, thereby inserting the shaft portion 33 into the third opening 202 and inserting the engaging portion 32 into the fourth opening 204.

When the elastic member 4, the liquid ejecting head 1, and the holding member 2 are lapped over such that the first opening 401 is orthogonal to the third opening 202 in plan view, the engaging portion 32, the second engaged portion 103, and the third opening 202 overlap in plan view. From another point of view, a rotational position where the engaging portion 32 is brought into engagement with the second engaged portion 103 is the same as a first position being a rotational position where the engaging portion 32 is insertable into the third opening 202. For this reason, the engaging portion 32 can be inserted into the third opening 202 by pushing the fixing member 3 straight in the z2 direction in the state where the elastic member 4 is fixed to the liquid ejecting head 1 by using the fixing member 3 as illustrated in FIG. 19. This configuration has good workability.

Next, as illustrated in FIG. 20, the engaging portion 32 is brought into engagement with the first engaged portion 203 such that the first opening 401 and the second opening 102 are disposed between the head portion 31 and the engaging portion 32 while the elastic member 4 is pressed with the head portion 31. Specifically, the fixing member 3 is rotated in the x-y plane about the shaft portion 33 as a rotational axis while the elastic member 4 is pressed with the head portion 31. To be more precise, the fixing member 3 is rotated by 90°. In this way, the liquid ejecting head 1 is fixed to the holding member 2.

By bringing the engaging portion 32 into engagement with the first engaged portion 203 such that the first opening 401 and the second opening 102 are disposed between the head portion 31 and the engaging portion 32 as described above, it is possible to fix the liquid ejecting head 1 to the holding member 2 easily without using the screws as in the related art. Thus, the liquid ejecting head 1 can be attached or replaced easily. Moreover, since it is only necessary to rotate the fixing member 3 by an angle below 180°, or more specifically equal to or below 90°, this operation greatly saves the labor of a worker.

In particular, the engaging portion 32 is engaged with the first engaged portion 203 by rotating the fixing member 3 in the x-y plane about the shaft portion 33 as the rotational axis in the state where the shaft portion 33 is inserted into the second opening 102 and the third opening 202. As a consequence, the liquid ejecting head 1 is fixed to the holding member 2. As described above, the liquid ejecting head 1 can be fixed to the holding member 2 easily by conducting the simple operation to rotate the fixing member 3 in the x-y plane. Thus, this operation greatly saves the labor of the worker.

Moreover, the engaging portion 32 is fitted into the first engaged portion 203 in this embodiment. This configuration can keep the state of engagement of the engaging portion 32 with the first engaged portion 203 from being released by vibration and other factors during printing after the liquid ejecting head 1 is fixed to the holding member 2. Accordingly, a favorable state of fixation of the liquid ejecting head 1 to the holding member 2 stably continues for a long period.

Meanwhile, as illustrated in FIG. 20, the second opening 102 is disposed below the holding member 2 in the gravitational direction. Moreover, the direction of insertion of the fixing member 3 is a direction upward from below in the gravitational direction. According to the method of fixing the liquid ejecting head 1 by using the fixing member 3, it is not necessary to conduct the three operations at the same time unlike the related art, namely, the operation to press the liquid ejecting head 1, the operation to hold the screws, and the operation to fix the screws with the tool. As a consequence, the liquid ejecting head 1 can be easily fixed to the holding member 2 even in the case of fixing the liquid ejecting head 1 to the holding member 2 upward from below in the gravitational direction, or in other words, in a case of bad workability where the liquid ejecting head 1 cannot be fixed to the holding member 2 while placing the liquid ejecting head 1 on the holding member 2.

Moreover, as described above, the hole of the third opening 202 included in the holding member 2 intersects with the hole of the second opening 102 included in the liquid ejecting head 1 in plan view. From another point of view, the first position being the rotational position where the engaging portion 32 is insertable into the third opening 202 is different from the second position being the rotational position where the engaging portion 32 is insertable into the second opening 102. For this reason, by rotating the fixing member 3 to the first position different from the second position, the worker can conduct the operation stably for inserting the fixing member 3 into the third opening 202 because the fixing member 3 does not drop even when the worker does not hold the fixing member 3. Meanwhile, the engaging portion 32 is located at the first position when the engagement of the engaging portion 32 with the first engaged portion 203 is released by rotating the fixing member 3 in the x-y plane in order to detach the liquid ejecting head 1 from the holding member 2. Accordingly, it is possible to keep the fixing member 3 from dropping due to the engaging portion 32 passing through the second opening 102 at the time of the release. This effect is particularly prominent in the case of fixing the liquid ejecting head 1 to the holding member 2 upward from below in the gravitational direction as in this embodiment because the fixing member 3 is prone to drop in this case.

Meanwhile, the holding member 2 includes the regulating portions 206 to regulate the rotation of the fixing member 3. Accordingly, when the fixing member 3 is rotated in the x-y plane, it is possible to bring the engaging portion 32 into engagement with the first engaged portion 203 easily just by releasing the push of the fixing member 3 in the z1 direction at a position where the engaging portion 32 butts one of the regulating portions 206.

In the meantime, the head portion 31 includes a groove 311 to which the tool for rotating the fixing member 3 is fitted. Accordingly, the liquid ejecting head 1 can be easily fixed to the holding member 2 by manipulating the fixing member 3 while using the tool such as a screw driver and a wrench having a shape corresponding to the groove 311. Moreover, the groove 311 is open in the z1 direction of the head portion 31. Hence, the liquid ejecting head 1 can be attached or replaced easily by using the tool that extends in the z1 direction even when there is not an enough space in the x-y plane.

Meanwhile, the elastic members 4 are provided separately from the liquid ejecting head 1 and the holding member 2. Each elastic member 4 is neither fixed to any of the liquid ejecting head 1 and the holding member 2, nor fixed by using a component other than the fixing member 3. Accordingly, the elastic member 4 is easily replaceable when the elastic member 4 is deteriorated by replacing the liquid ejecting heads 1 a number of times, for example. Moreover, since the elastic member 4 is not fixed to the liquid ejecting head 1 or the holding member 2, it is easier to elastically deform the elastic member 4 and to push the fixing member 3 into the fourth opening 204. Furthermore, by providing the elastic member 4 separately without fixation to the liquid ejecting head 1, the elastic member 4 can also be used in another aspect in which the elastic member 4 is provided on the surface on the opposite side of the surface provided with the first flange portion 152*a* and the second flange portion 152*b*. In this way, the layout of the elastic member 4 relative to the first flange portion 152*a* and the second flange portion 152*b* can be changed easily. In this embodiment, the liquid ejecting head 1 is fixed to the holding member 2 from below in the vertical direction. On the other hand, the layout of the elastic member 4 can be easily changed when the liquid ejecting head 1 is fixed to the holding member 2 from above in the vertical direction, for example.

In the meantime, as described above, the length of the shaft portion 33 is set such that the elastic member 4 does not cause plastic deformation. Meanwhile, in the state where the engaging portion 32 is engaged with the first engaged portion 203, a distance from the surface of the head portion 31 in contact with the elastic member 4 to the second opening 102 is set below an amount of deformation in the z1 direction of the elastic member 4 when the elastic member 4 is deformed to an upper yield point that represents a limit of elasticity thereof. In this way, it is possible to prevent the elastic member 4 from being plastically deformed even when a load in the z1 direction is applied to the liquid ejecting head 1 in a case where an externally provided wiring member is inserted in the z1 direction and coupled to the connector 112 of the liquid ejecting head 1, for example, and when the elastic member 4 is deformed in the z-axis direction by that load.

Meanwhile, the holder 15 and the holding member 2 are formed from materials having different linear expansion coefficients, respectively. To be more precise, the body portion 21 of the holding member 2 that is elongate in the x-axis direction and the second opening 102 of the holder 15 are formed from materials having different linear expansion coefficients, respectively. Even when the holder 15 or the holding member 2 becomes deformed due to the difference in linear expansion coefficient therebetween, the provision of the elastic member 4 can stably maintain the state of fixation of the liquid ejecting head 1 to the holding member 2 as compared to the case of not providing the elastic member 4. Thus, the materials of the holder 15 and the holding member 2 can be selected from appropriate materials, respectively. In this way, the degree of design freedom can be improved.

In the meantime, the holding member 2 is located at the position in the z2 direction relative to the first flange portion 152*a* of the liquid ejecting head 1. For this reason, it is possible to reduce the holding member 2 in size as compared to the case of locating the holding member 2 sideways of the first flange portion 152*a*.

2. Second Embodiment

A second embodiment will be described. Note that in the following explanations of examples, the elements having the same functions as those of the first embodiment will be denoted by the reference signs used in the description of the first embodiment and detailed explanations thereof will be omitted as appropriate.

Figure 21:
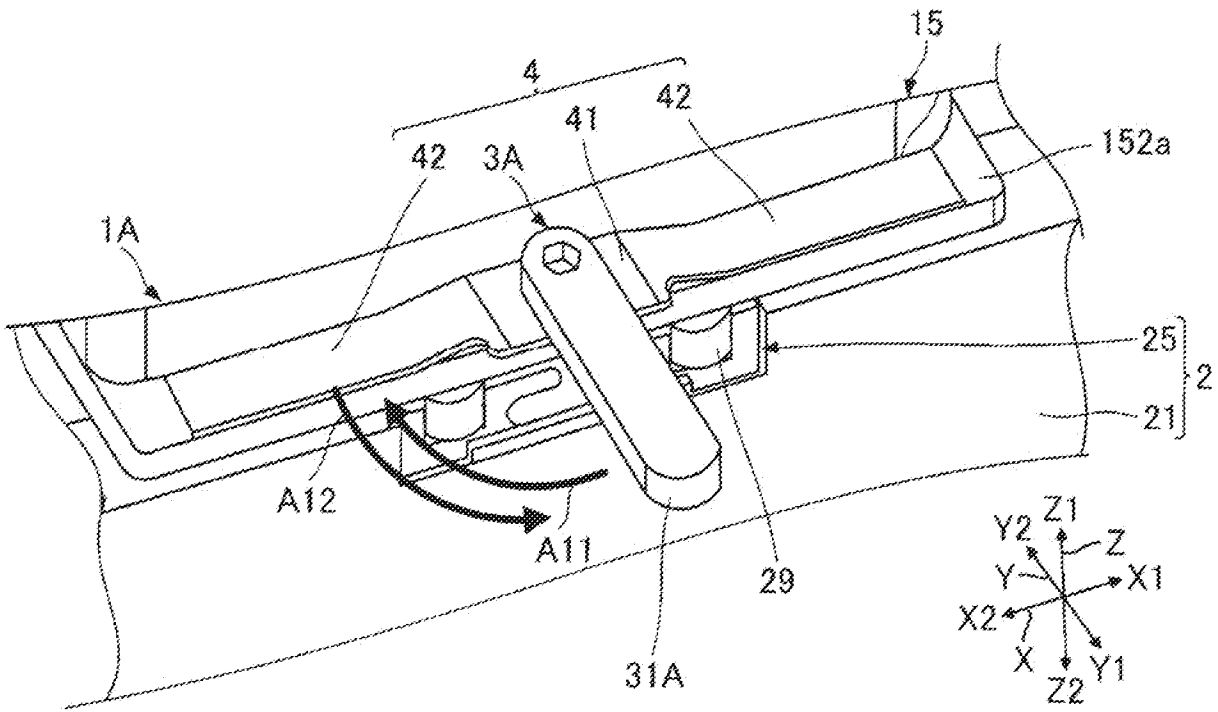
FIG. 21 is a perspective view illustrating a fixing member of a second embodiment.

FIG. 21 is a perspective view illustrating a fixing member 3A of the second embodiment. This embodiment is the same as the first embodiment except that the fixing member 3A is used instead of the fixing member 3. In the following, features of the fixing member 3A which are different from those of the fixing member 3 of the first embodiment will be described while omitting the explanations of the same features as appropriate.

The fixing member 3A illustrated in FIG. 21 includes a head portion 31A instead of the head portion 31 of the first embodiment. The head portion 31A is a lever for rotating the fixing member 3A in the x-y plane. Since the head portion 31A is the lever, it is possible to fix the liquid ejecting head 1 to the holding member 2 by the fixing member 3A without using a tool. Accordingly, the liquid ejecting head 1 can be attached and replaced more easily as compared to the case of using the tool.

Specifically, the head portion 31A of the fixing member 3A is formed to be rotatable in a direction indicated with an arrow A11 and in a direction indicated with an arrow A12 about the shaft portion 33. For example, the shaft portion 33 of the fixing member 3A is inserted into the first opening 401 and the second opening 102 in the state of rotating 90° in the A11 direction from the state of the fixing member 3A illustrated in FIG. 21. Next, the engaging portion 32 is brought into engagement with the second engaged portion 103 by rotating the head portion 31A in the direction indicated with the arrow A12 from the state after rotating 90° in the A11 direction from the state of the fixing member 3A illustrated in FIG. 21. Then, the engaging portion 32 is brought into engagement with the first engaged portion 203 by pushing the fixing member 3A in the z2 direction, and restoring the state of the fixing member 3A illustrated in FIG. 21 from the state of the fixing member 3A illustrated in FIG. 21 back to the state of rotating 90° in the A11 direction by rotating the head portion 31A in the direction indicated with the arrow A11. By carrying out the above-described operations of the head portion 31A, it is possible to attach and replace the liquid ejecting head 1 easily.

Meanwhile, in the state where the liquid ejecting head 1 is fixed to the holding member 2, the fixing member 3A is in the state of being rotated by 90° in the A11 direction from the state of the fixing member 3A illustrated in FIG. 21. This configuration makes it possible to achieve reduction in size of the head unit 10.

3. Third Embodiment

A third embodiment will be described. Note that in the following explanations of examples, the elements having the same functions as those of the first embodiment will be denoted by the reference signs used in the description of the first embodiment and detailed explanations thereof will be omitted as appropriate.

Figure 22:
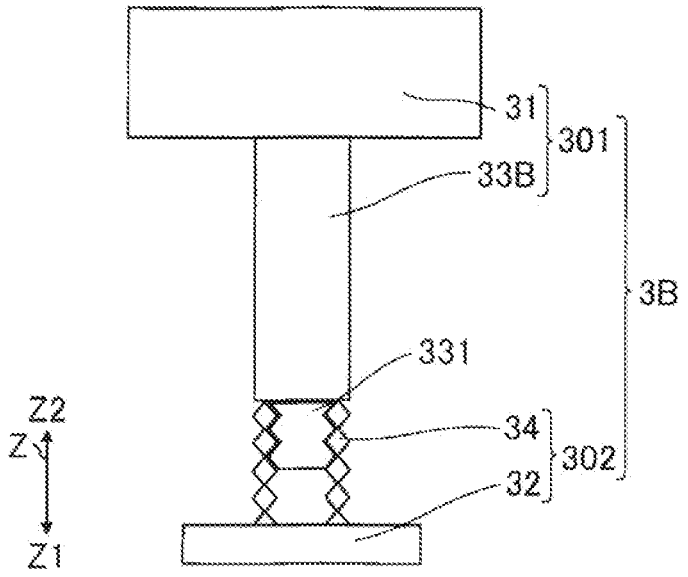
FIG. 22 is a cross-sectional view illustrating a fixing member of a third embodiment.
Figure 23:
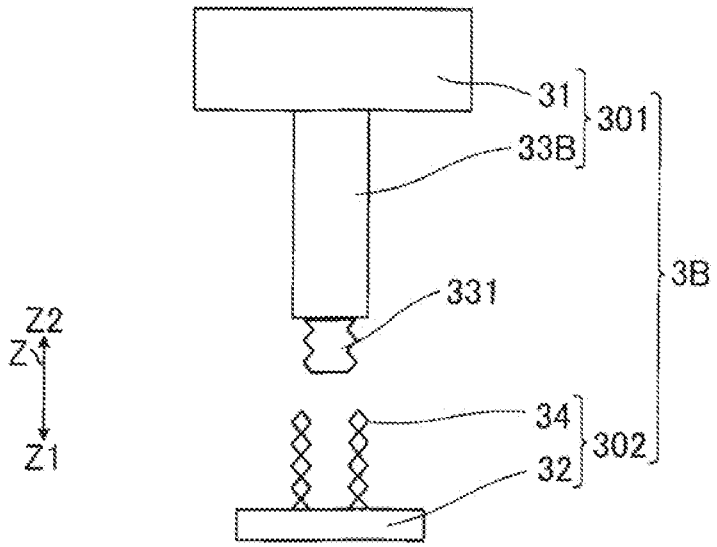
FIG. 23 is a cross-sectional view illustrating the fixing member of the third embodiment in an exploded state.

FIG. 22 is a cross-sectional view illustrating a fixing member 3B of the third embodiment. FIG. 23 is a cross-sectional view illustrated an exploded state of the fixing member 3B of the third embodiment. This embodiment is the same as the first embodiment except that the fixing member 3B is used instead of the fixing member 3. In the following, features of the fixing member 3B which are different from those of the fixing member 3 of the first embodiment will be described while omitting the explanations of the same features as appropriate.

As illustrated in FIGS. 22 and 23, the fixing member 3B is formed from more than one member. Specifically, the fixing member 3B includes a first member 301 and a second member 302. The first member 301 and the second member 302 are separable and assemblable. The first member 301 includes the head portion 31 and a first shaft portion 33B. The second member 302 includes the engaging portion 32 and a second shaft portion 34. The "shaft portion" is formed from the first shaft portion 33B and the second shaft portion 34. That is to say, in this embodiment, the "shaft portion" is formed from both the first member 301 and the second member 302.

As illustrated in FIG. 23, the first shaft portion 33B includes a tip end portion 331 that is engageable with the second shaft portion 34. The tip end portion 331 is located at an opposite end from the head portion 31 of the first shaft portion 33B. A male screw is formed on an outer peripheral surface of the tip end portion 331, for example. Meanwhile, the second shaft portion 34 is formed to be engageable with the tip end portion 331. A female screw is formed on an inner peripheral surface of the second shaft portion 34, for example. The first member 301 is fixed to the second member 302 as illustrated in FIG. 22 by fitting the second member 302 into the first member 301.

When the liquid ejecting head 1 is fixed to the holding member 2 by using the fixing member 3B, the first member 301 is fixed to the second member 302 in the state where the "shaft portion" that is formed from the first shaft portion 33B included in the first member 301 and the second shaft portion 34 included in the second member 302 is inserted into both the first opening 401 and the second opening 102. Specifically, the first member 301 is fixed to the second member 302 in the state where the "shaft portion" formed from the first shaft portion 33B and the second shaft portion 34 is inserted into both the first opening 401 and the second opening 102. Meanwhile, the shapes of the respective holes of the first opening 401 and the second opening 102 are designed in conformity to shapes of the first shaft portion 33B and the second shaft portion 34, for example. Moreover, the shapes of the respective holes of the first opening 401 and the second opening 102 are formed into such shapes that block insertion of the engaging portion 32 and the head portion 31.

Accordingly, unlike the first embodiment, the rotating operation of the fixing member 3B is not required in a period until the fixing member 3B is inserted into both the first opening 401 and the second opening 102. Moreover, since the engaging portion 32 and the head portion 31 have the shapes that cannot be inserted into the respective holes of the first opening 401 and the second opening 102, the fixing member 3B and the elastic member 4 are kept from coming off the liquid ejecting head 1 after the first member 301 is fixed to the second member 302. Accordingly, it is possible to prevent the fixing member 3B and the elastic member 4 from dropping in the course of fixation of the liquid ejecting head 1. Moreover, the shapes of the respective holes of the first opening 401 and the second opening 102 can be designed in conformity to the shapes of the first shaft portion 33B and the second shaft portion 34. To be more precise, the respective holes can be formed into circular holes in conformity to transverse sectional shapes of the first shaft portion 33B and the second shaft portion 34, for example. As a consequence, it is possible to process the respective members easily and to improve mechanical strengths of the respective members, or of the elastic member 4 in particular.

Note that the method of fixing the first member 301 to the second member 302 is not limited only to screw fastening and the fixing method may adopt adhesion or press fitting, for example.

Although the "shaft portion" is formed from both the first member 301 and the second member 302 in this embodiment, the "shaft portion" may be formed from only one of the first member 301 and the second member 302. Specifically, although the "shaft portion" is formed from the first shaft portion 33B and the second shaft portion 34 in this embodiment, the "shaft portion" may be formed from only one of the first shaft portion 33B and the second shaft portion 34. For example, when a male screw is formed at an end portion of the second shaft portion 34 of the second member 302 on the opposite side of the engaging portion 32, and the fixing member 3B is formed by bringing the male screw into engagement with a female screw formed inside the head portion 31, the first member 301 does not include the first shaft portion 33B to serve as part of the "shaft portion". Accordingly, the "shaft portion" is formed only from the second shaft portion 34 of the second member 302. In other words, the "shaft portion" is formed only from the second member 302 out of the first member 301 and the second member 302.

4. Modified Examples

The above-described embodiments may be modified in various modes. Specific aspects of modifications applicable to the above-described embodiments will be discussed below as examples. Two or more aspects selected arbitrarily from the following examples may be combined as appropriate so far as those aspects do not conflict with one another.

4-1. First Modified Example

Figure 24:
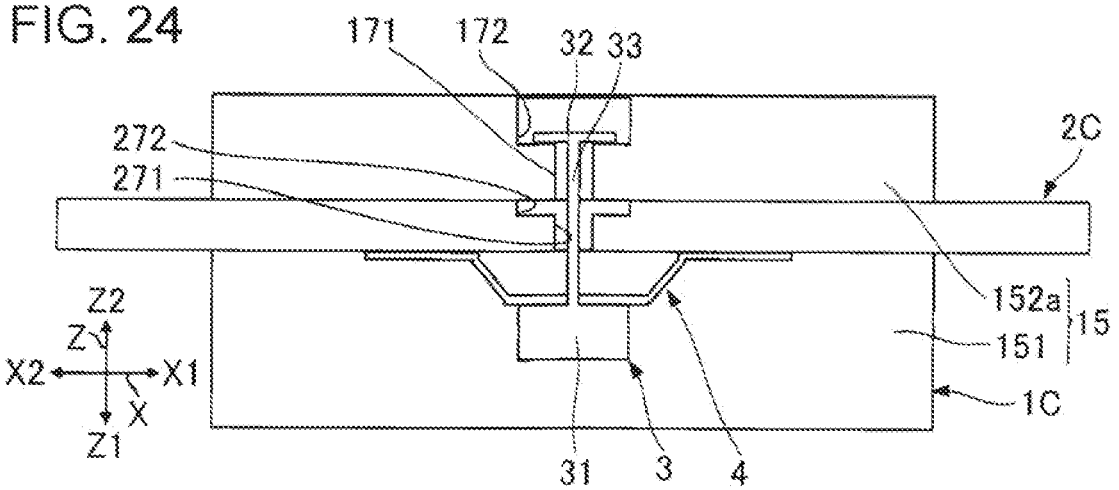
FIG. 24 is a diagram schematically illustrating a liquid ejecting head and a holding member of a first modified example.

FIG. 24 is a diagram schematically illustrating a liquid ejecting head 1C and a holding member 2C according to a first modified example. In the above-described embodiments, the first flange portion 152*a* included in the liquid ejecting head 1 is located at the position in the z1 direction relative to the holding member 2. Meanwhile, in the example illustrated in FIG. 24, the first flange portion 152*a* is located at a position in the z2 direction relative to part of the holding member 2.

In this case, the holding member 2C includes a second opening 271 and a second engaged portion 272. The second opening 271 has a structure, functions, and effects which are the same as those of the second opening 102 of the first embodiment. The second engaged portion 272 has a structure, functions, and effects which are the same as those of the second engaged portion 103 of the first embodiment. Meanwhile, the liquid ejecting head 1C includes a third opening 171 and a first engaged portion 172. The third opening 171 has a structure, functions, and effects which are the same as those of the third opening 202 of the first embodiment. The first engaged portion 172 has a structure, functions, and effects which are the same as those of the first engaged portion 203 of the first embodiment.

Accordingly, in the first modified example as well, the liquid ejecting head 1C is fixed to the holding member 2C by the engaging portion 32 being brought into engagement with the first engaged portion 172 of the liquid ejecting head 1C such that the first opening 401 included in the elastic member 4 and the second opening 271 included in the holding member 2C are disposed between the head portion 31 and the engaging portion 32 included in the fixing member 3 as with the first embodiment.

Note that both a longitudinal direction of the first engaged portion 172 and a longitudinal direction of the second engaged portion 272 are illustrated in line with the x1 direction for facilitating the understanding of the description in FIG. 24. Nonetheless, as with the above-described embodiments, the longitudinal direction of the first engaged portion 172 may intersect with the longitudinal direction of the second engaged portion 272 in order to prevent the fixing member 3 from dropping.

4-2. Second Modified Example

Figure 25:
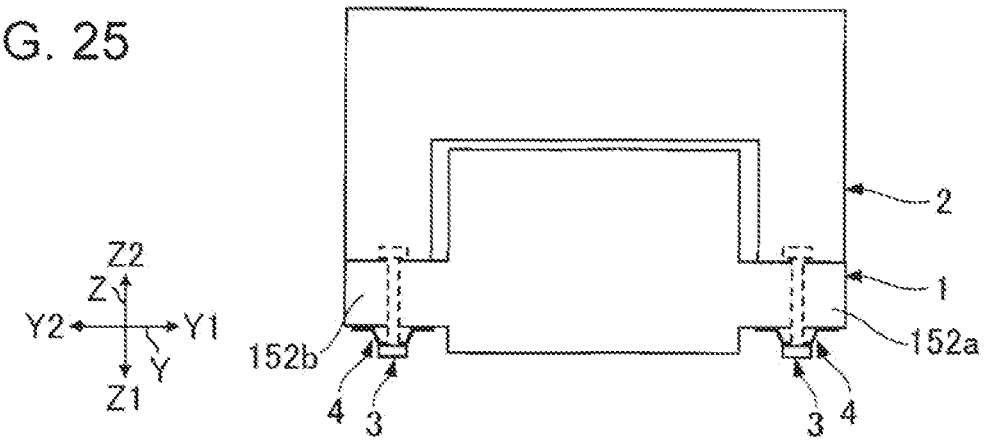
FIG. 25 is a diagram illustrating a layout of the liquid ejecting head and the holding member of the first embodiment.
Figure 26:
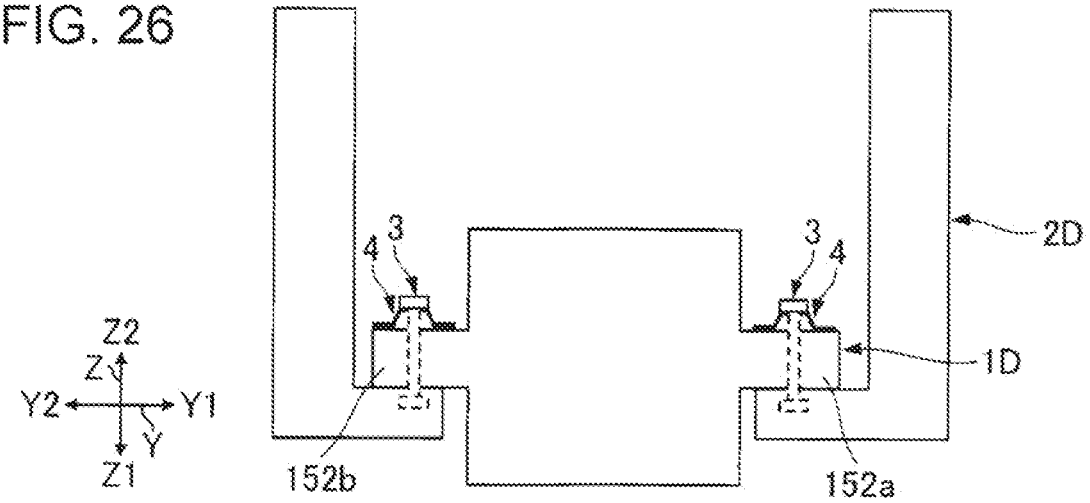
FIG. 26 is a diagram schematically illustrating a layout of a liquid ejecting head and a holding member of a second modified example.

FIG. 25 is a diagram illustrating a layout of the liquid ejecting head 1 and the holding member 2 of the first embodiment. FIG. 26 is a diagram illustrating a layout of a liquid ejecting head 1D and a holding member 2D of a second modified example. In the first embodiment, the holding member 2 is located at the position in the z2 direction relative to the first flange portion 152*a* as illustrated in FIG. 25. In this case, the fixing member 3 is attached to the liquid ejecting head 1 and the holding member 2 upward from below in the gravitational direction. On the other hand, when part of the holding member 2 is located at a position in the z1 direction relative to the first flange portion 152*a* of the liquid ejecting head 1D as illustrated in FIG. 26, the fixing member 3 may be attached to the liquid ejecting head 1 and the holding member 2 from above downward in the gravitational direction.

Moreover, since the holding member 2 is located at the position in the z2 direction relative to the first flange portion 152*a* as illustrated in FIG. 25, the holding member 2 is not disposed sideways of the second opening 102. Since the holding member 2 is located at the position in the z2 direction relative to the first flange portion 152*a*, it is easier to reduce the size of the liquid ejecting head 1 as compared to the example illustrated in FIG. 26. Since a space inside the holding member 2 can be reduced as illustrated in FIG. 25, it is easier to reduce the size of the liquid ejecting head 1. Moreover, by fixing the fixing member 3 upward from below in the gravitational direction, a distance between the ejecting surface S11 and the fixing member 3 is reduced. Thus, it is possible to improve positional accuracy of the nozzles.

4-3. Third Modified Example

Figure 27:
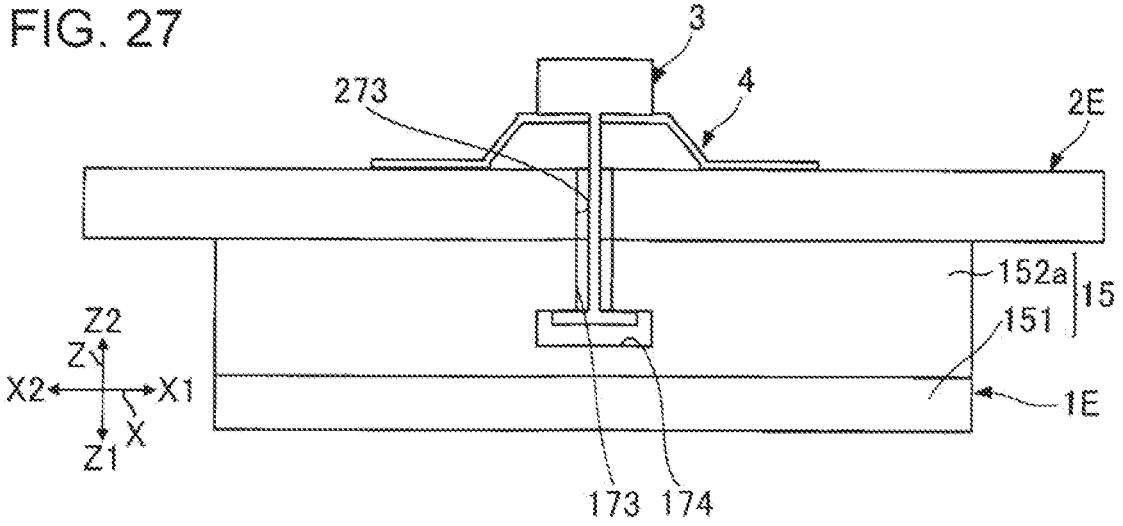
FIG. 27 is a diagram schematically illustrating a liquid ejecting head and a holding member of a third modified example.

FIG. 27 is a diagram schematically illustrating a liquid ejecting head 1E and a holding member 2E of a third modified example. In the example illustrated in FIG. 27, the holding member 2E is located above the first flange portion 152*a* and the base portion 151 in the gravitational direction. In the case of this example, the fixing member 3 can be attached to the liquid ejecting head 1E and the holding member 2E from above downward in the gravitational direction.

In this case, the holding member 2E includes a second opening 273. The second opening 273 has a structure, functions, and effects which are the same as those of the second opening 102 of the first embodiment. Here, the "second engaged portion" may be omitted when the liquid ejecting head 1E is fixed to the holding member 2E from above downward in the gravitational direction. Meanwhile, the liquid ejecting head 1E includes a third opening 173 and a first engaged portion 174. The third opening 173 has a structure, functions, and effects which are the same as those of the third opening 202 of the first embodiment. The first engaged portion 174 has a structure, functions, and effects which are the same as those of the first engaged portion 203 of the first embodiment.

4-4. Fourth Modified Example

Figure 28:
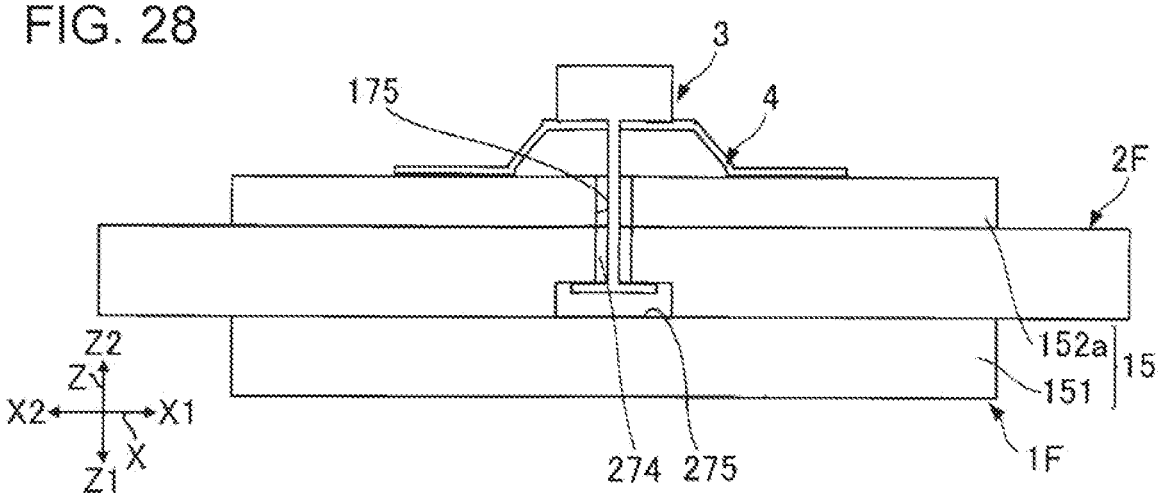
FIG. 28 is a diagram schematically illustrating a liquid ejecting head and a holding member of a fourth modified example.

FIG. 28 is a diagram schematically illustrating a liquid ejecting head 1F and a holding member 2F of a fourth modified example. In the example illustrated in FIG. 28, the holding member 2F is located above the base portion 151 in the gravitational direction and is located below the first flange portion 152*a* in the gravitational direction. In the case of this example, the fixing member 3 can be attached to the liquid ejecting head 1F and the holding member 2F from above downward in the gravitational direction.

In this case, the liquid ejecting head 1F includes a second opening 175. The second opening 175 has a structure, functions, and effects which are the same as those of the second opening 102 of the first embodiment. Here, the "second engaged portion" may be omitted when the liquid ejecting head 1F is fixed to the holding member 2F from above downward in the gravitational direction. Meanwhile, the holding member 2F includes a third opening 274 and a first engaged portion 275. The third opening 274 has a structure, functions, and effects which are the same as those of the third opening 202 of the first embodiment. The first engaged portion 275 has a structure, functions, and effects which are the same as those of the first engaged portion 203 of the first embodiment.

4-5. Fifth Modified Example

Figure 29:
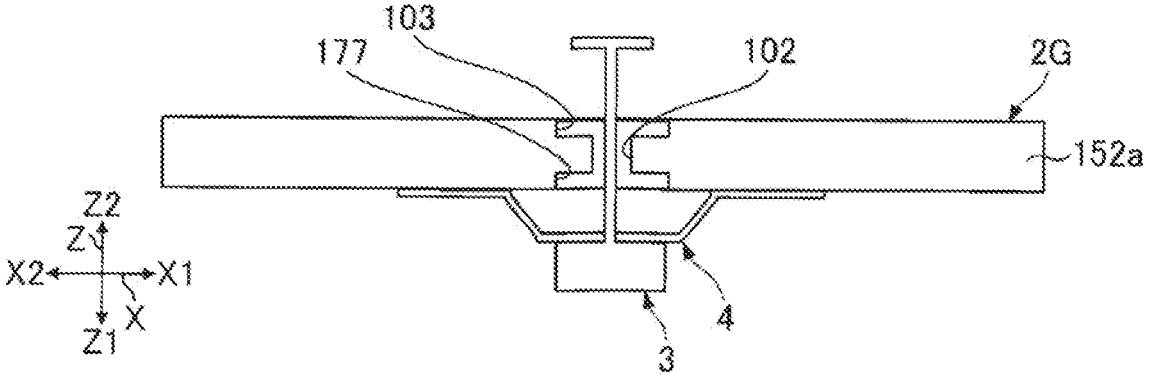
FIG. 29 is a diagram schematically illustrating a holding member of a fifth modified example.

FIG. 29 is a diagram schematically illustrating a holding member 2G of a fifth modified example. As illustrated in FIG. 29, the holding member 2G further includes a second engaged portion 177 in addition to the second opening 102 and the second engaged portion 103. In other words, the holding member 2G includes two "second engaged portions". The second engaged portion 103 is located at a position in the z2 direction of the second opening 102 and the second engaged portion 177 is located at a position in the z1 direction of the second opening 102. Accordingly, in the example illustrated in FIG. 29, the "second engaged portions" are provided in two surfaces of the second opening 102. For this reason, it is possible to insert the fixing member 3 into the second opening 102 of the holding member 2G upward from below in the gravitational direction as illustrated in FIG. 29, and also to insert the fixing member 3 into the second opening 102 of the holding member 2G from above downward in the gravitational direction. Hence, the direction of insertion of the fixing member 3 can be changed easily depending on a layout relation between the liquid ejecting head 1 and the holding member 2G.

4-6. Sixth Modified Example

Figure 30:
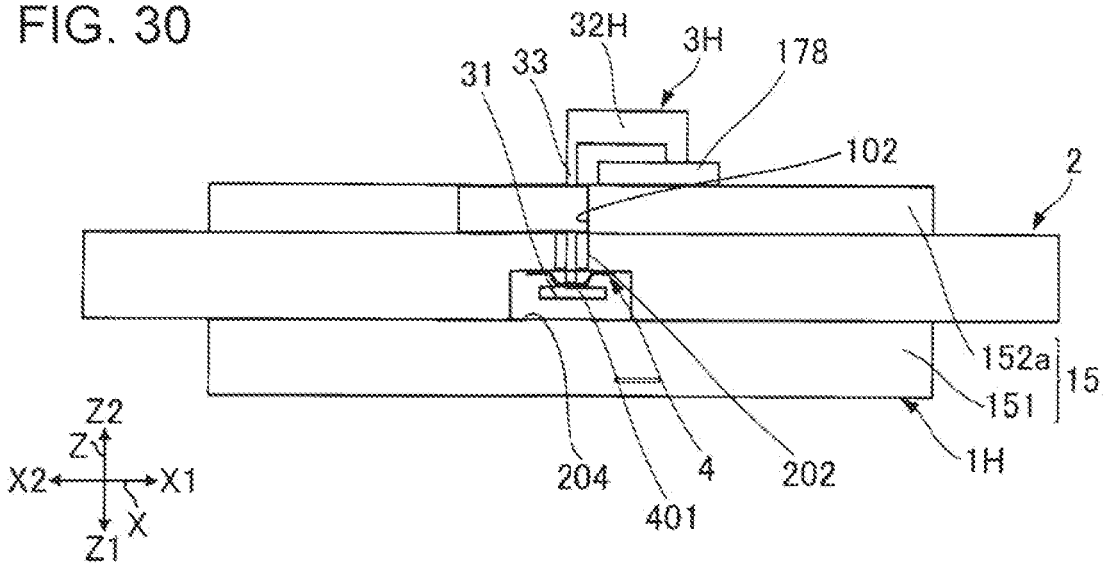
FIG. 30 is a diagram schematically illustrating a fixing member and a liquid ejecting head of a sixth modified example.
Figure 31:
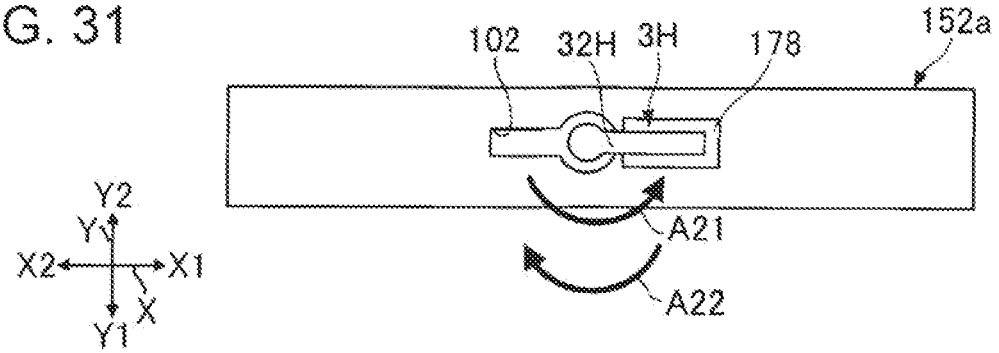
FIG. 31 is a plan view of the fixing member and a first flange portion of the liquid ejecting head illustrated in FIG. 30.

FIG. 30 is a diagram schematically illustrating a fixing member 3H and a liquid ejecting head 1H of a sixth modified example. FIG. 31 is a plan view of the fixing member 3H and the first flange portion 152*a* of the liquid ejecting head 1H illustrated in FIG. 30. In the example illustrated in FIG. 30, an engaging portion 32H included in the fixing member 3H also functions as the operating portion for performing the rotating operation of the fixing member 3H in the x-y plane with respect to the liquid ejecting head 1H when fixing the liquid ejecting head 1H. Here, the head portion 31 comes into contact with the elastic member 4.

Moreover, the liquid ejecting head 1H includes a first engaged portion 178 to be engaged with the engaging portion 32H. The first engaged portion 178 is a protrusion that protrudes in the z2 direction from the first flange portion 152*a*.

Meanwhile, the second opening 102 of the liquid ejecting head 1H is configured such that the engaging portion 32H can be inserted into the opening. As illustrated in FIG. 31, the engaging portion 32H is rotatable in a direction indicated with an arrow A21 and a direction indicated with an arrow A22.

For example, the engaging portion 32H in a state of being located in the second opening 102 is rotated in the direction indicated with the arrow A21, thus locating the engaging portion 32H at a position indicated in FIG. 31. Then, the engaging portion 32H is brought into engagement with the first engaged portion 178 of the liquid ejecting head 1H as illustrated in FIGS. 30 and 31. Accordingly, in the sixth modified example as well, the liquid ejecting head 1H is fixed to the holding member 2 by the engaging portion 32H being brought into engagement with the first engaged portion 178 such that the first opening 401 and the third opening 202 are disposed between the head portion 31 and the engaging portion 32H included in the fixing member 3H as with the first embodiment.

4-7. Seventh Modified Example

Figure 32:
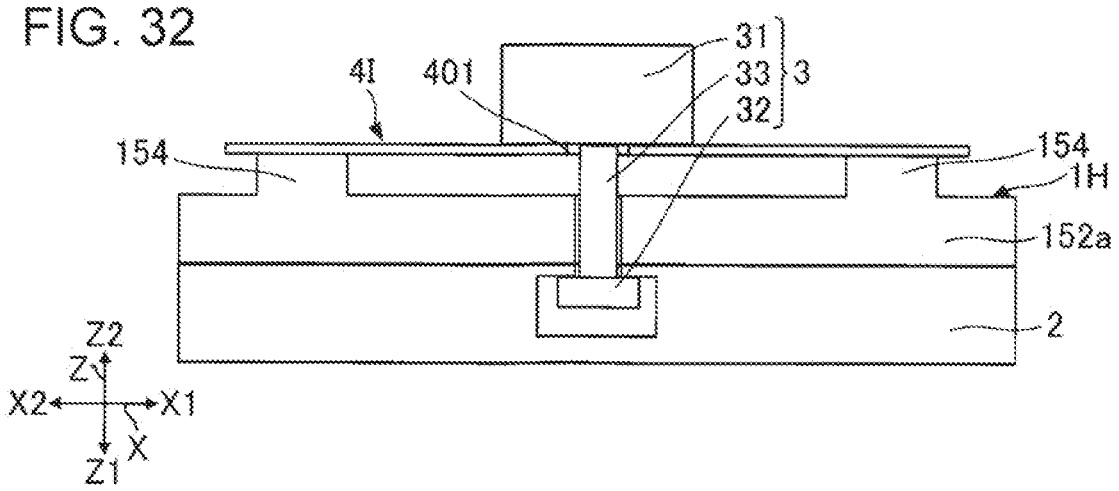
FIG. 32 is a diagram schematically illustrating an elastic member of a seventh modified example.

FIG. 32 is a diagram schematically illustrating an elastic member 41 of a seventh modified example. The elastic member 41 illustrated in FIG. 32 is a spring member having a flat plate shape without any bent portion. Meanwhile, the liquid ejecting head 1H includes protrusions 154 that protrude in the z2 direction from the first flange portion 152*a*. The elastic member 41 is disposed on the protrusions 154. The use of the elastic member 41 can improve the positional accuracy of the liquid ejecting head 1H relative to the holding member 2 as compared to the case of using the elastic member 4 of the first embodiment.

4-8. Eighth Modified Example

Figure 33:
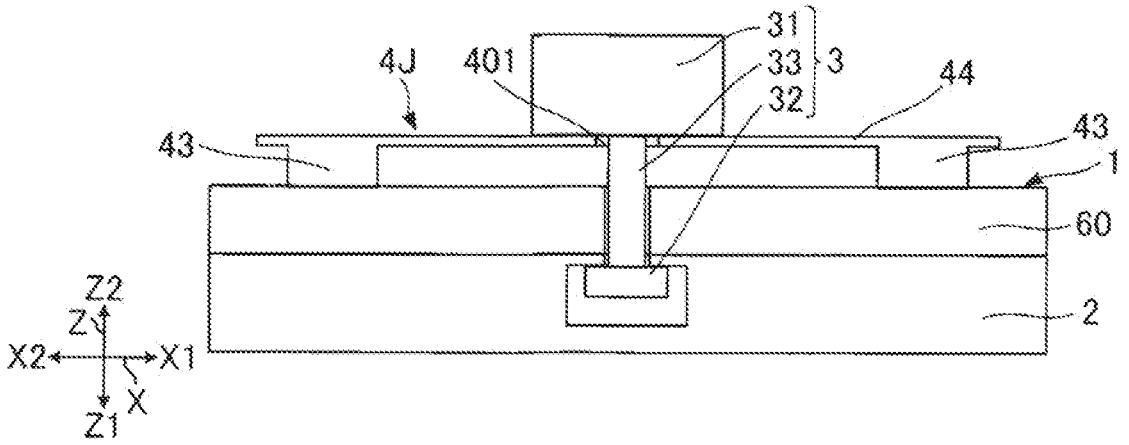
FIG. 33 is a diagram schematically illustrating an elastic member of an eighth modified example.

FIG. 33 is a diagram schematically illustrating an elastic member 4J of an eighth modified example. The elastic member 4J illustrated FIG. 33 includes a flat plate portion 44 having a flat plate shape without any bent portion, and protrusions 43 that protrude in the z1 direction from the flat plate portion 44. The protrusions 43 come into contact with the liquid ejecting head 1. The use of the elastic member 4J can improve the positional accuracy of the liquid ejecting head 1 relative to the holding member 2 as compared to the case of using the elastic member 4 of the first embodiment.

4-9. Ninth Modified Example

Figure 34:
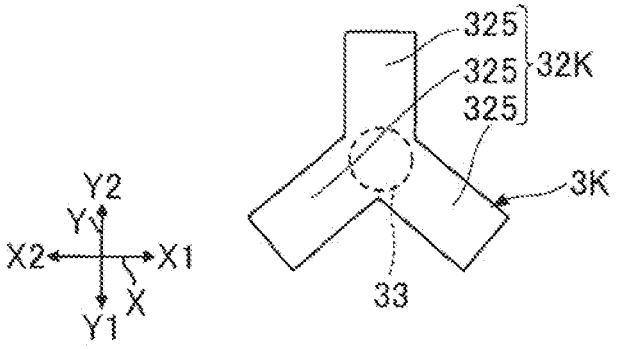
FIG. 34 is a diagram schematically illustrating a fixing member of a ninth modified example.

FIG. 34 is a plan view schematically illustrating a fixing member 3K of a ninth modified example. In the example illustrated in FIG. 34, an engaging portion 32K of the fixing member 3K includes three projections 325 that extend in the x-y plane from the shaft portion 33 in plan view.

A shape of this "engaging portion" may take on any shape as long as the shape is engageable with the "first engaged portion". Nevertheless, by proving the engaging portion 32K with the projections 325 as illustrated in FIG. 34, it is possible to reduce a rotation angle of the fixing member 3 in the x-y plane as compared to the engaging portion 32 of the first embodiment. In the first embodiment, the fixing member 3 is rotated by 90° when fixing the liquid ejecting head 1 to the holding member 2. In contrast, the use of the fixing member 3K illustrated in FIG. 34 can reduce the rotation angle of the fixing member 3K to 60°, for example. Thus, the liquid ejecting head 1 can be fixed to the holding member 2 more easily.

In the meantime, the "shaft portion" may also take on a shape in plan view other than the circular shape as long as such a shape does not affect the functions of the shaft portion. Moreover, the "head portion" may also take on a shape in plan view other than the circular shape as long as such a shape does not affect the functions of the head portion.

4-10. Tenth Modified Example

Figure 35:
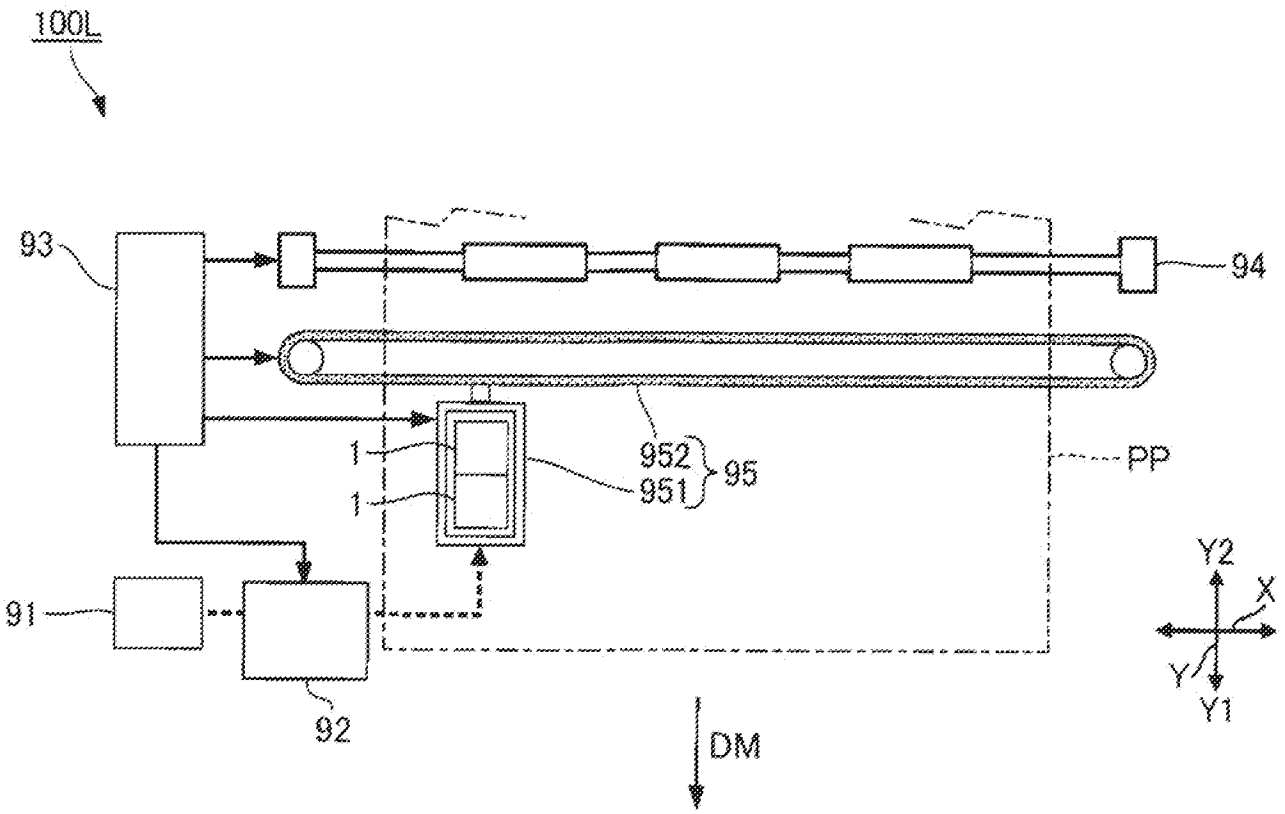
FIG. 35 is a schematic diagram illustrating a liquid ejecting apparatus of a tenth modified example.

FIG. 35 is a schematic diagram illustrating a liquid ejecting apparatus 100L of a tenth modified example. The liquid ejecting apparatus 100L illustrated in FIG. 35 is a printing apparatus of a serial type. The liquid ejecting apparatus 100L includes the liquid ejecting heads 1 arranged in the direction of transportation DM of the medium PP. The liquid ejecting heads 1 are arranged in the x-axis direction.

The liquid ejecting apparatus 100L includes a head transportation mechanism 95. The head transportation mechanism 95 includes a carriage 951 and an endless belt 952. The carriage 951 holds liquid ejecting heads 1. The carriage 951 is coupled to the endless belt 952. The carriage 951 is transported by the endless belt 952 so as to reciprocate in a main scanning direction.

When a printing operation is executed, the liquid ejecting apparatus 100L ejects the ink from the liquid ejecting heads 1 while reciprocating the liquid ejecting heads 1 in the main scanning direction and transporting the medium PP in a vertical scanning direction being intersecting with the main scanning direction at the same time. As a consequence, dots corresponding to print data are formed on the medium PP and an image is thus printed on the medium PP.

The liquid ejecting heads 1 are also applied to the above-described liquid ejecting apparatus 100L of the serial type.

4-11. Other Modified Examples

In the above-described embodiments, the groove 311 is formed at the head portion 31 of the fixing member 3. Here, a shape of the groove 311 is not limited to a particular shape. For example, the groove 311 may take on a polygonal shape such as a rectangle and a hexagon, a cross shape, an I-shape, and the like.

Meanwhile, the elastic member 4 is the plate spring in the above-described embodiments. Instead, the elastic member 4 may be any of a coil spring, a disc spring, and a waved washer, for example. Nonetheless, the use of the plate spring can easily shorten the distance between the fixing member 3 and the liquid ejecting head 1 as compared to the case of using the coil spring. Here, an attempt to dispose the first flange portion 152*a* close to the ejecting surface S11 in order to improve the positioning accuracy results in the reduced distance from the ejecting surface S11 to the first flange portion 152*a* in a direction of ejection. In this case, it is difficult to use the coil spring that requires a certain dimension in the z1 direction which is the direction of ejection. In contrast, the plate spring bears a high load and requires a small dimension in the direction of ejection, and is therefore suitable.

In the above-described embodiments, the second flange portion 152*b* includes the two positioning holes 1521. Instead, the two positioning holes 1521 may be provided to the first flange portion 152*a*. In this case, the elastic member 4 is disposed between the two positioning holes 1521 in plan view.

In the above-described embodiments, the engaged member 25 is provided with the regulating portions 206. However, the engaged member 25 does not always have to be provided with the regulating portions 206. In this way, it is possible to rotate the fixing member 3 in both a clockwise direction and a counterclockwise direction in the x-y plane.

It is to be understood that the above-described embodiments merely illustrate representative modes of the present disclosure and that the present disclosure is not limited only to the above-described embodiments. Various alterations and additions are possible within the scope not departing from the gist of the present disclosure.

Besides the apparatus dedicated to printing, the liquid ejecting apparatuses shown as the examples in the above-described aspects may also be adopted as various apparatuses including a facsimile apparatus, a copier, and the like. As a matter of fact, the usage of the liquid ejecting apparatus is not limited only to printing. For example, a liquid ejecting apparatus that ejects a solution of a coloring material is used as a manufacturing apparatus for forming a color filter of a display device such as a liquid crystal display panel. Meanwhile, a liquid ejecting apparatus that ejects a solution of a conductive material is used as a manufacturing apparatus for forming wiring and electrodes on a wiring board. In the meantime, a liquid ejecting apparatus that ejects a solution of an organic substance related to a biological object is used as a manufacturing apparatus for manufacturing a biochip, for instance.

What is claimed is:

1. A liquid ejecting apparatus comprising:

a liquid ejecting head configured to eject a liquid;

a holding member holding the liquid ejecting head;

a fixing member including a head portion, an engaging portion, and a shaft portion that couples the head portion to the engaging portion; and an elastic member including a first opening into which the shaft portion is inserted, wherein one of the liquid ejecting head and the holding member includes a second opening into which the shaft portion is inserted, and another one of the liquid ejecting head and the holding member includes a first engaged portion to be engaged with the engaging portion, and the liquid ejecting head is fixed to the holding member by the engaging portion being brought into engagement with the first engaged portion such that the first opening and the second opening are disposed between the head portion and the engaging portion.

2. The liquid ejecting apparatus according to claim 1, wherein the other one of the liquid ejecting head and the holding member includes a third opening into which the shaft portion and the engaging portion are inserted, and the liquid ejecting head is fixed to the holding member by the fixing member being rotated about the shaft portion as a rotational axis in a state where the shaft portion is inserted into the third opening.

3. The liquid ejecting apparatus according to claim 2, wherein the first engaged portion forms a groove open to a surface of the third opening opposite from a surface of the third opening facing the second opening, and the engaging portion is fitted into the first engaged portion by the fixing member being rotated about the shaft portion as the rotational axis.

4. The liquid ejecting apparatus according to claim 2, wherein a first position being a rotational position where the engaging portion is configured to be inserted into the third opening is different from a second position being a rotational position where the engaging portion is configured to be inserted into the second opening.

5. The liquid ejecting apparatus according to claim 4, wherein the second position is identical to a rotational position where the engaging portion is configured to be inserted into the first opening.

6. The liquid ejecting apparatus according to claim 1, wherein the one of the liquid ejecting head and the holding member includes a second engaged portion configured to be engaged with the engaging portion.

7. The liquid ejecting apparatus according to claim 6, wherein the one of the liquid ejecting head and the holding member further includes another second engaged portion, the second engaged portion being provided on a first side of the second opening and the other second engaged portion being provided on a second side of the second opening opposite from the first side of the second opening.

8. The liquid ejecting apparatus according to claim 6, wherein a rotational position where the engaging portion is brought into engagement with the second engaged portion is identical to the first position.

9. The liquid ejecting apparatus according to claim 1, wherein the other one of the liquid ejecting head and the holding member includes a regulating portion that regulates rotation of the fixing member.

10. The liquid ejecting apparatus according to claim 1, wherein the head portion includes any of a hole and a groove to be fitted to a tool to rotate the fixing member.

11. The liquid ejecting apparatus according to claim 1, wherein the head portion is a lever to rotate the fixing member.

12. The liquid ejecting apparatus according to claim 1, wherein the fixing member includes a first member including the head portion, and a second member including the engaging portion, and the first member is fixed to the second member in a state where the shaft portion formed from at least one of the first member and the second member is inserted into both the first opening and the second opening.

13. The liquid ejecting apparatus according to claim 1, wherein the elastic member is provided separately from the liquid ejecting head and the holding member.

14. The liquid ejecting apparatus according to claim 1, wherein the second opening of the liquid ejecting head and the holding member are formed from materials having different linear expansion coefficients.

15. The liquid ejecting apparatus according to claim 1, wherein the liquid ejecting head includes the second opening, the second opening is disposed below the holding member in a gravitational direction, and a direction of insertion of the fixing member is a direction upward from below in the gravitational direction.

16. A method of fixing a liquid ejecting head comprising:

fixing a liquid ejecting head to a holding member by using a fixing member including a head portion, an engaging portion, and a shaft portion that couples the head portion to the engaging portion, and an elastic member including a first opening into which the shaft portion is inserted, the elastic member being brought into contact with the head portion, wherein one of the liquid ejecting head and the holding member includes a second opening into which the shaft portion is inserted, and another one of the liquid ejecting head and the holding member includes a first engaged portion to be engaged with the engaging portion, and the liquid ejecting head is fixed to the holding member by the engaging portion being brought into engagement with the first engaged portion such that the first opening and the second opening are disposed between the head portion and the engaging portion while the elastic member is pressed with the head portion.

17. The method of fixing a liquid ejecting head according to claim 16, wherein a direction of insertion of the fixing member when the liquid ejecting head is fixed to the holding member is a direction upward from below in a gravitational direction, and before the engaging portion is brought into engagement with the first engaged portion, the fixing member is inserted into the first opening and the second opening and then the fixing member is rotated about the shaft portion as a rotational axis.

18. The method of fixing a liquid ejecting head according to claim 17, wherein the one of the liquid ejecting head and the holding member includes a second engaged portion to be engaged with the engaging portion, and the engaging portion is brought into engagement with the second engaged portion before the engaging portion is brought into engagement with the first engaged portion.

19. The method of fixing a liquid ejecting head according to claim 16, wherein the fixing member includes a first member including the head portion, and a second member including the engaging portion, and before the engaging portion is brought into engagement with the first engaged portion, the first member is fixed to the second member in a state where the shaft portion formed from at least one of the first member and the second member is inserted into both the first opening and the second opening.

* * * * *